US006585540B2

(12) United States Patent
Gutierrez et al.

(10) Patent No.: US 6,585,540 B2
(45) Date of Patent: Jul. 1, 2003

(54) SHIELDED MICROELECTRONIC CONNECTOR ASSEMBLY AND METHOD OF MANUFACTURING

(75) Inventors: Aurelio J. Gutierrez, Bonita, CA (US); Bruce I. Doyle, III, San Diego, CA (US); Dallas A. Dean, Oceanside, CA (US)

(73) Assignee: Pulse Engineering, San Diego, CA (US)

( * ) Notice: Subject to any disclaimer, the term of this patent is extended or adjusted under 35 U.S.C. 154(b) by 0 days.

(21) Appl. No.: 09/732,098

(22) Filed: Dec. 6, 2000

(65) Prior Publication Data

US 2002/0068484 A1 Jun. 6, 2002

(51) Int. Cl.[7] ..... H01R 13/66

(52) U.S. Cl. ..... 439/620; 439/607; 439/676; 439/941

(58) Field of Search ..... 439/620, 608, 439/676, 607, 941

(56) References Cited

U.S. PATENT DOCUMENTS

| | | | |
|---|---|---|---|
| 3,422,394 | A | 1/1969 | Antes |
| 4,109,986 | A | 8/1978 | Mouissie |
| 4,461,522 | A | 7/1984 | Bakermans et al. |
| 4,695,115 | A | 9/1987 | Talend |
| 4,701,002 | A | 10/1987 | Mouissie |
| 4,726,638 | A | 2/1988 | Farrar et al. |
| 4,772,224 | A | 9/1988 | Talend |
| 4,978,317 | A | 12/1990 | Pocrass |
| 4,995,834 | A | 2/1991 | Hasegawa |
| 5,011,438 | A | 4/1991 | Awbrey |
| 5,015,204 | A | 5/1991 | Sakamoto et al. |
| 5,015,981 | A | 5/1991 | Lint et al. |
| 5,069,641 | A | 12/1991 | Sakamoto et al. |
| 5,139,442 | A | 8/1992 | Sakamoto et al. |
| 5,178,563 | A | 1/1993 | Reed |
| 5,239,748 | A | 8/1993 | Hamilton |
| 5,282,759 | A | 2/1994 | Sakamoto et al. |
| 5,362,257 | A | 11/1994 | Neal et al. |
| 5,397,250 | A | 3/1995 | Briones |
| 5,399,107 | A | 3/1995 | Gentry et al. |
| 5,403,207 | A | 4/1995 | Briones |
| 5,456,619 | A | 10/1995 | Belopolsky et al. |
| 5,475,921 | A | 12/1995 | Johnston |
| 5,496,195 | A | 3/1996 | Reed |
| 5,531,612 | A | 7/1996 | Goodall et al. |
| 5,562,507 | A | 10/1996 | Kan |
| 5,587,884 | A | 12/1996 | Raman |

(List continued on next page.)

OTHER PUBLICATIONS

Application Ser. No. 09/524,311 entitled "Shielded Microelectronic Connector with Indicators and Method of Manufacturing," filed Mar. 13, 2000—Attorney Docket No. PULSE.033A.

*Primary Examiner*—P. Austin Bradley
*Assistant Examiner*—Truc Nguyen
(74) *Attorney, Agent, or Firm*—Gazdzinski & Associates

(57) ABSTRACT

An advanced multi-connector electronic assembly incorporating different noise shield elements which reduce noise interference and increase performance. In one embodiment, the connector assembly comprises a plurality of connectors with associated electronic components arranged in two parallel rows, one disposed atop the other. The assembly utilizes a substrate shield which mitigates noise transmission through the bottom surface of the assembly, as well as an external "wrap-around shield to mitigate noise transmission through the remaining external surfaces. In a second embodiment, the connector assembly further includes a top-to-bottom shield interposed between the top and bottom rows of connectors to reduce noise transmission between the rows of connectors, and a plurality of front-to-back shield elements disposed between the electronic components of respective top and bottom row connectors to limit transmission between the electronic components. A method of manufacturing the assembly is also disclosed.

33 Claims, 20 Drawing Sheets

U.S. PATENT DOCUMENTS 5,639,267 A 6/1997 Loudermilk
5,647,767 A 7/1997 Scheer et al.
5,687,233 A 11/1997 Loudermilk et al.
5,697,817 A 12/1997 Bouchan
5,736,910 A 4/1998 Townsend et al.
5,766,043 A 6/1998 Talend
5,775,946 A 7/1998 Briones
5,872,492 A 2/1999 Boutros
5,876,239 A 3/1999 Morin et al.
5,924,890 A 7/1999 Morin et al.
5,928,005 A 7/1999 Li et al.
5,934,940 A 8/1999 Maranto et al.
5,971,805 A 10/1999 Belopolsky et al.
5,971,813 A 10/1999 Kunz et al.
6,019,631 A 2/2000 Chen
6,062,908 A 5/2000 Jones
6,080,011 A 6/2000 Tsao et al.
6,129,587 A 10/2000 Huang
6,139,366 A 10/2000 van Woensel
6,159,050 A 12/2000 Belopolsky et al.
6,162,089 A 12/2000 Costello et al.
6,193,560 B1 2/2001 Morana et al.
6,224,425 B1 5/2001 Shutter (SHEET 1 OF 3)

(SHEET 2 OF 3)

(SHEET 3 OF 3)

SHIELDED MICROELECTRONIC CONNECTOR ASSEMBLY AND METHOD OF MANUFACTURING

BACKGROUND OF THE INVENTION

1. Field of the Invention

The present invention relates generally to microminiature electronic elements and particularly to an improved design and method of manufacturing a multi-connector assembly having noise shielding and internal electronic components.

2. Description of Related Technology

Multi-connector assemblies are well known in the electronic connector arts. As shown in FIGS. 1*a*–1*c*, such assemblies 100 typically comprise a number of rows 101 and columns 103 of individual connectors 104 (such as the RJ 11 or RJ 45 type) arranged so as to allow the simultaneous insertion and connection of multiple modular plugs (not shown) into the plug recesses 106 of the connectors. See, also, for example, U.S. Pat. No. 6,193,560 issued Feb. 27, 2001, co-owned by the Assignee hereof. There are several major considerations in designing and manufacturing such a multi-connector assembly, including: (i) shielding the individual connectors against externally generated electromagnetic interference (EMI) or "noise", (ii) the size or volume consumed by the assembly, (iii) reliability, and (iv) the cost of manufacturing.

With respect to EMI, prior art multi-connector assemblies such as that of FIGS. 1*a*–1*c* are typically constructed from a molded plastic housing 102 in which the individual connectors 104 are integrally formed, and an external metallic noise shield 172 which wraps around or envelops much of the external surface area of the connector housing. This approach of using merely an external "wrap-around" noise shield 172 has several drawbacks, however. Specifically, such an arrangement does not provide complete or even near-complete shielding of the individual connectors 104 in the assembly 100, since the bottom surface 111 of the connector housing is often left largely unshielded due to concerns of reduced reliability due to electrical shorting between the connector conductors 120 and the metallic shield 172. This "gap" in the shielding decreases the overall performance of the connector assembly 100 by decreasing the signal-to-noise ratio (SNR) resulting from the increased noise. Additionally, such wrap-around external shields 172 do not address the issue of cross-connector noise leakage; i.e., noise radiated by the components of one connector in the assembly interfering with the signal of the other connectors, and vice-versa.

Accordingly, attempts have been made to provide additional shielding between the individual connectors in the assembly, including providing one or more shield elements between the conductors thereof. See U.S. Pat. No. 5,531,612 entitled "Multi-port Modular Jack Assembly" issued Jul. 2, 1996 ('612 patent). While an improvement over the aforementioned prior art devices using only a "wrap around" noise shield, the invention of the '612 patent suffers from several disabilities, including inter alia: (i) no provision for noise shielding between the connector assembly and the substrate (e.g., PCB) to which it is mounted; and (ii) The use of substantially perpendicular molded conductor inserts 140*a*, 140*b* or carriers (two per connector) which complicate the manufacture and assembly of the device and increase cost of manufacturing. Additionally, the device disclosed in the '612 patent does not include filtering, voltage transformation, or other electronic components for each connector integrally within the assembly itself, hence, no provision for physically accommodating and shielding such components is provided.

A related issue concerns the use of noise-emitting sources such as light emitting diodes (LEDs) 160 in the connectors of the assembly; such components are also potentially significant sources of EMI, and therefore should in many cases be shielded from the other connector components in order to achieve optimal performance. Prior art multi-connector assemblies such as that of FIGS. 1*a*–1*c* or the '612 patent typically have no provision for shielding of the LEDs from the other connector assembly components, a significant disability. Rather, the LEDs 160 are commonly disposed physically within the external shield 172, often in close proximity to other connector components such as the conductors 120 and in-line electronic filters (not shown).

Since in general consumers are highly sensitive to the cost and pricing of multi-connector assemblies, there exists a constant tension between producing a multi-connector assembly which has the best possible (noise) performance with the lowest possible cost. Hence, the most desirable situation is that where comprehensive external and cross-component noise shielding can be implemented with little impact on the cost of the finished product as a whole. Additionally, since board space ("footprint") and volume are such important factors in miniaturized electronic components, improvements in performance and noise shielding ideally should in no way increase the size of the component. Lastly, the connector assembly must also optimally include signal filtering/conditioning components such as inductive reactors (i.e., "choke" coils), transformers, and the like with no penalty in terms of space or noise performance.

Based on the foregoing, it would be most desirable to provide an improved multi-connector assembly and method of manufacturing the same. Such an improved assembly would be reliable, and provide enhanced external and intra-connector noise suppression, including suppressing noise between integral electronic components and the substrate to which the assembly is mounted, while occupying a minimum volume. Additionally, such improved device could be manufactured easily and cost-efficiently.

SUMMARY OF THE INVENTION

The present invention satisfies the aforementioned needs by providing an improved shielded multi-connector assembly, and method of manufacturing the same.

In a first aspect of the invention, an improved shielded connector assembly for use on, inter alia, a printed circuit board or other electronic substrate is disclosed. In one exemplary embodiment, the assembly comprises a connector housing having a plurality of connector recesses; a plurality of conductors disposed within each of the plurality of recesses; and a shielded substrate disposed relative to the connector housing and providing shielding there for. The connector housing is formed from a non-conductive polymer and comprises multiple rows of individual RJ45 or RJ11 connectors, each having a plurality of conductors adapted to mate with the corresponding conductors of a modular plug received within the respective recesses. The conductors of each individual connector are formed so as to obviate the need for overmolded carriers, and are disposed on a removable electronic component package. The terminal end of the conductors penetrates the shielded substrate disposed on the bottom of the connector housing, the substrate being a multi-layered device specially constructed to provide shielding against electromagnetic interference (EMI) or other deleterious electronic noise. The substrate further acts to help register the terminal ends of the conductors to facilitate rapid and easy connection to an external component. An external noise shield is also installed to shield against electronic noise transmitted via surfaces other than the bottom of the housing. In a second embodiment, the shielded substrate comprises a single-layer copper alloy shield which is shaped to cover the majority of surface area on the bottom of the connector.

In a second embodiment, the connector assembly further includes a top-to-bottom shield element disposed substantially between the horizontal rows of connectors, the top-to-bottom shield providing noise separation between the conductors of the connectors in each row. In one variant, the top-to-bottom shield element comprises a removable metallic strip which is received within a preformed groove existing between the rows of individual connectors. In another variant, the top-to-bottom shield is formed as a thin metallic film within the connector housing during fabrication. The assembly further includes individual front-to-back shielding elements disposed between the electronic component packages of each individual connector, the front-to-back shielding elements providing noise separation between the electronic components within each adjacent package. In one variant the front-to-back shielding elements comprise a copper alloy insert which is held in place between the component packages of the first and second row connectors. In another variant, the shielding elements comprise a thin copper film which is deposited on the back of the first row component package.

In a third embodiment, the assembly further includes a plurality of light sources (e.g., light-emitting diodes, or LEDs) adapted for viewing by an operator during operation. The light sources advantageously permit the operator to determine the status of each of the individual connectors simply by viewing the front of the assembly. Optional shielding proximate to the LEDs for suppressing noise emitted by the LEDs is also disclosed.

In a second aspect of the invention, an improved electronic assembly utilizing the aforementioned connector assembly is disclosed. In one exemplary embodiment, the electronic assembly comprises the foregoing shielded connector assembly which is mounted to a printed circuit board (PCB) substrate having a plurality of conductive traces formed thereon, and bonded thereto using a soldering process, thereby forming a conductive pathway from the traces through the conductors of the respective connectors of the package. In another embodiment, the connector assembly is mounted on an intermediary substrate, the latter being mounted to a PCB or other component using a reduced footprint terminal array.

In a third aspect of the invention, an improved method of manufacturing the connector assembly of the present invention is disclosed. The method generally comprises the steps of forming an assembly housing having a plurality of modular plug recesses disposed therein, the recesses being formed in at least first and second rows; providing a plurality of conductors comprising a first set adapted for use with the first row of connectors within the housing element, and a second set adapted for use with the second row; forming the end of the conductors to be received within the aforementioned plug recesses so as to mate with corresponding conductors of a modular plug; providing a shielded substrate and an external shield; installing the first set of conductors in the first row of connectors in the housing element; installing the second set of conductors in the second row of connectors in the housing element; installing the shielded substrate on one side of the housing element; and installing the outer shield around at least a portion of the remaining exposed sides of the housing element. In one embodiment, the connectors comprise RJ11 connectors, and the method further comprises providing at least one electrical component (e.g., filter or choke coil) in the conductive pathway of at least one of the sets of conductors in order to condition the signal passed via the conductors. The external shield is also soldered to various points on the shielded substrate so as to add rigidity to the assembly. In another embodiment, the method further comprises providing a top-to-bottom shield and a plurality of front-to-back shield elements; installing the top-to-bottom shield between the first and second rows of connectors; installing the front-to-back shield elements between the electronic components present in the conductive pathways of the various connectors; and bonding the front to-back shield elements to the top-to-bottom shield element, and the top-to-bottom shield element to the external shield.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Reference is now made to the drawings wherein like numerals refer to like parts throughout.

It is noted that while the following description is cast primarily in terms of a plurality of RJ-type connectors and associated modular plugs of the type well known in the art, the present invention may be used in conjunction with any number of different connector types. Accordingly, the following discussion of the RJ connectors and plugs is merely exemplary of the broader concepts.

Figure 1A:
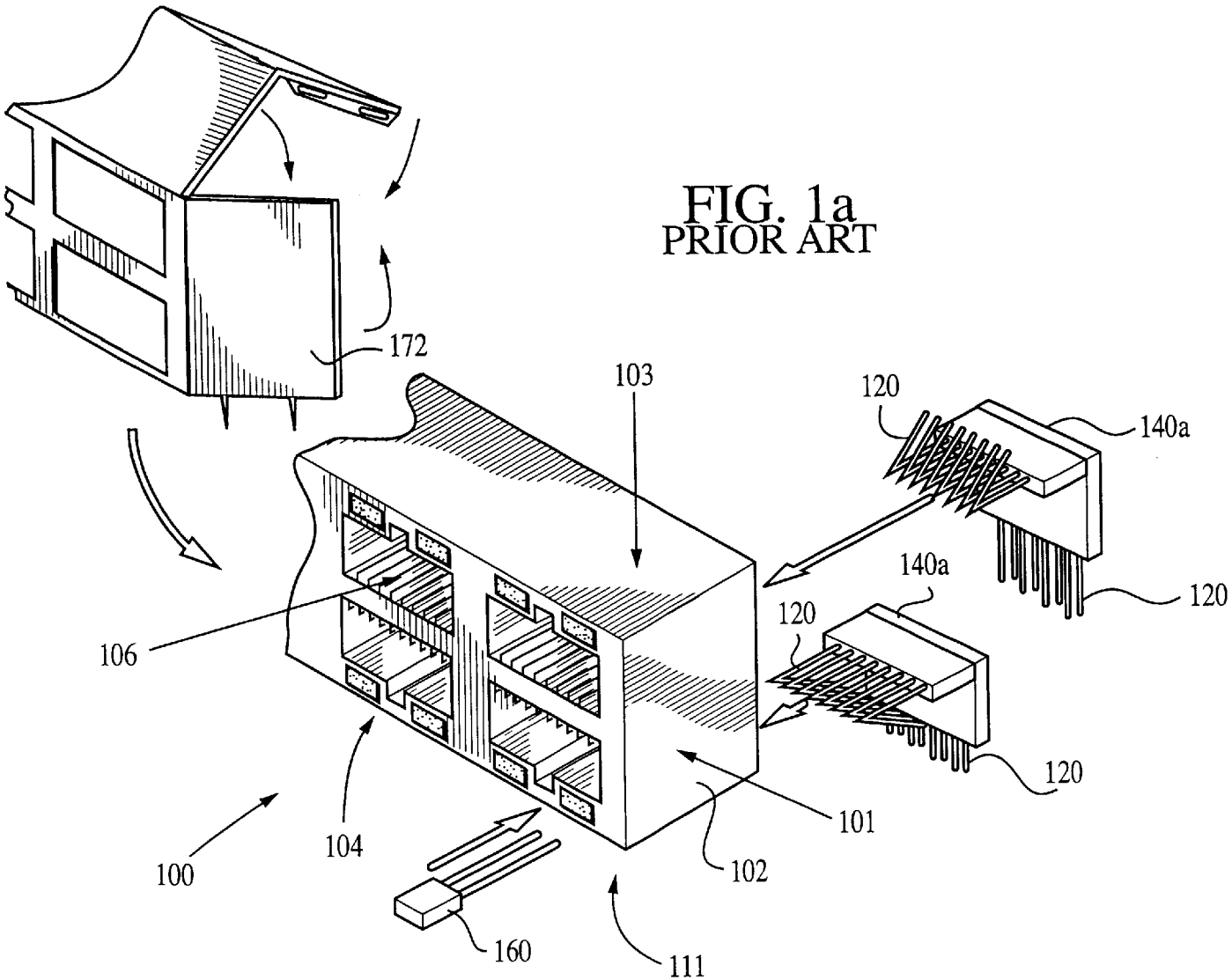
FIG. 1a PRIOR ART
FIG. 1*a* is a perspective assembly view of a typical prior art shielded multi-connector assembly, illustrating the components thereof.
Figure 1B:
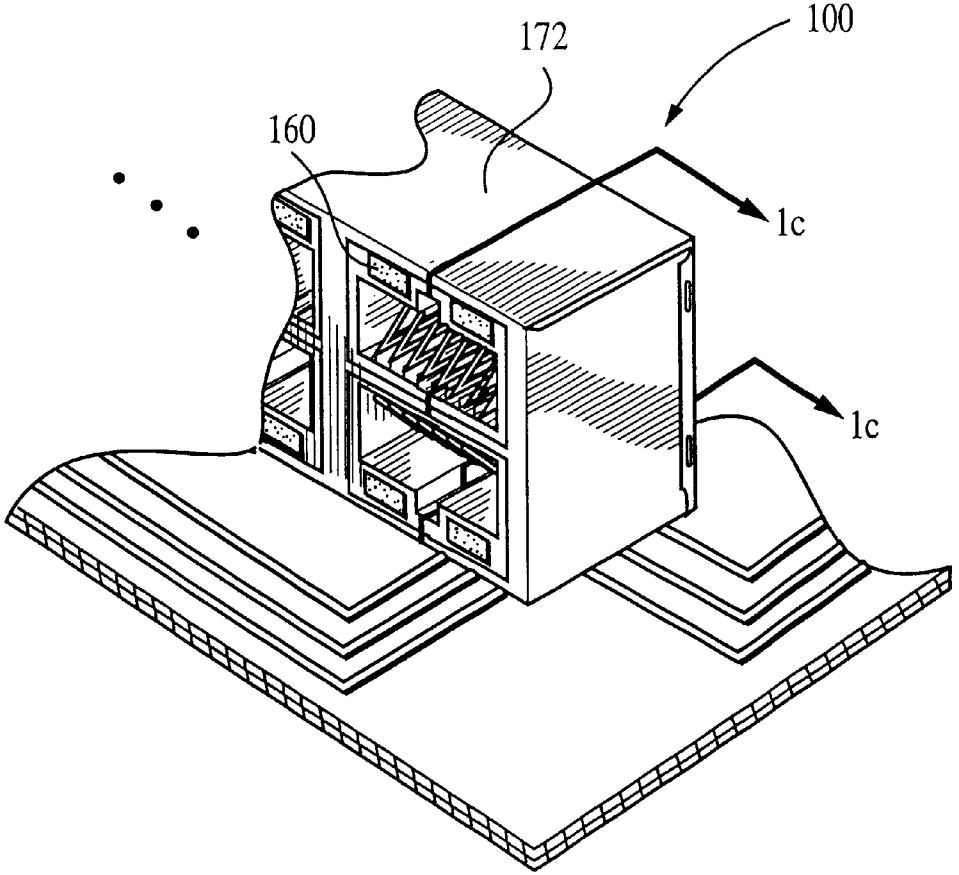
FIG. 1b PRIOR ART
FIG. 1*b* is a perspective view of the connector assembly of FIG. 1*a* after assembly and mounting on a substrate (PCB).
Figure 1C:
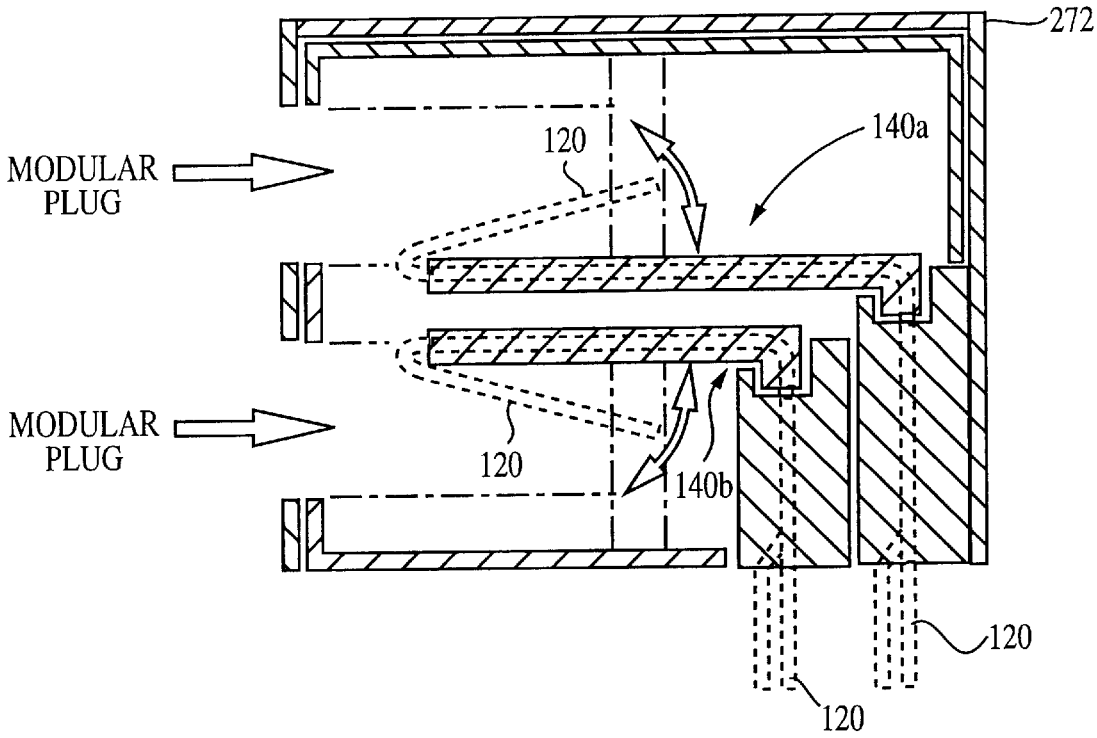
FIG. 1c PRIOR ART
FIG. 1*c* is a cross-sectional view of the assembled connector assembly of FIG. 1*b* taken along line 1—1, illustrating the relationship of the various components.
Figure 2A:
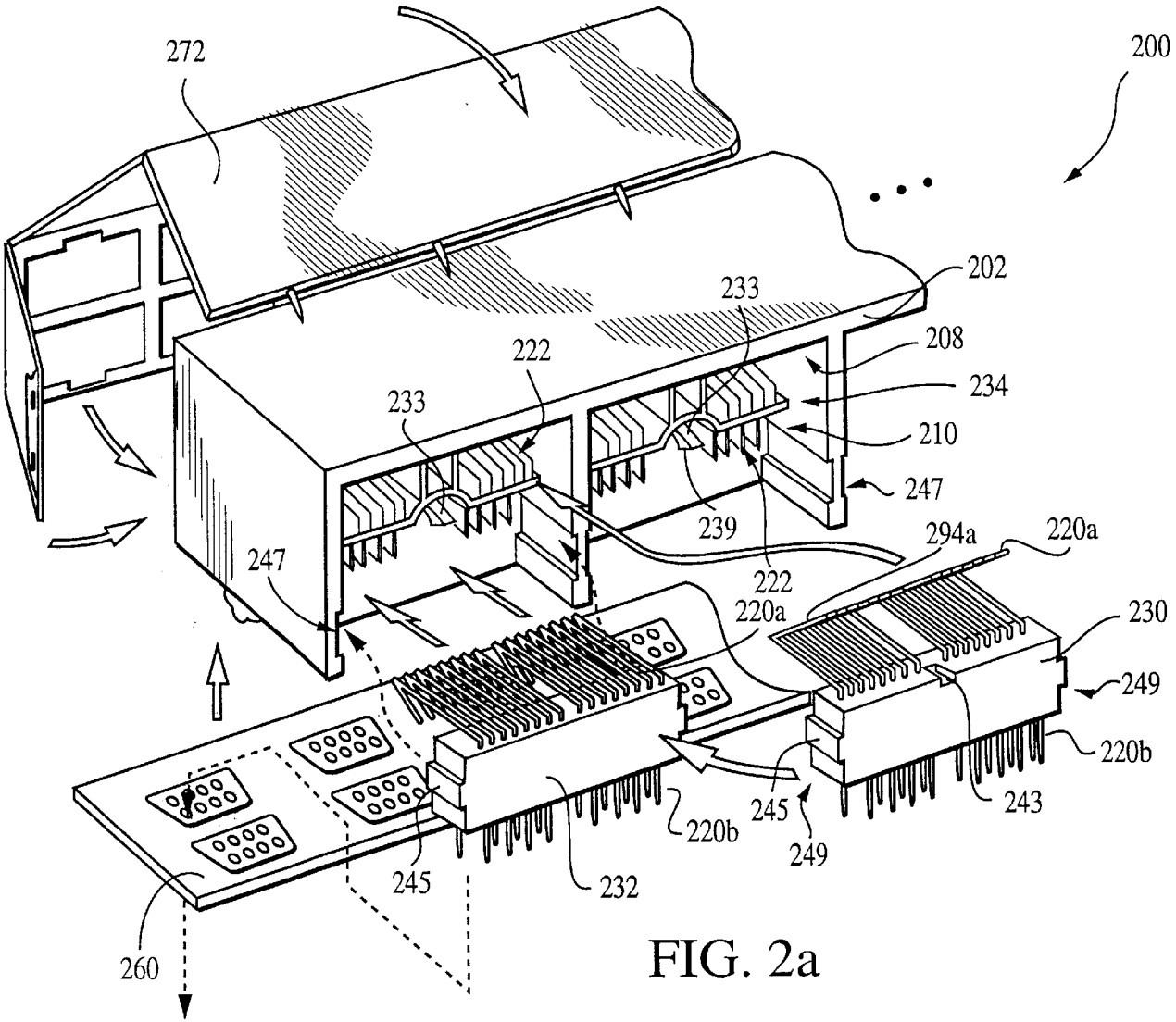
FIG. 2*a* is an assembly view of a first exemplary embodiment of the connector assembly according to the present invention, including the external and substrate noise shields.
Figure 2B:
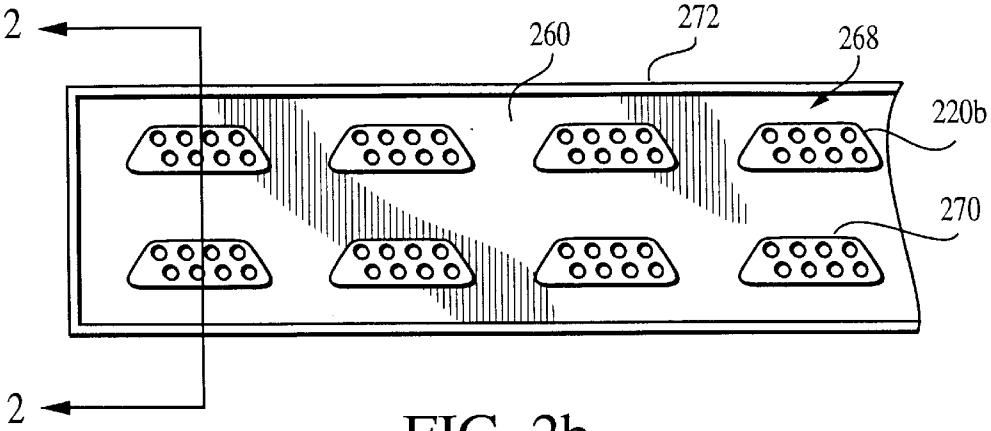
FIG. 2*b* is a bottom plan view of the assembled connector of FIG. 2*a*.
Figure 2C:
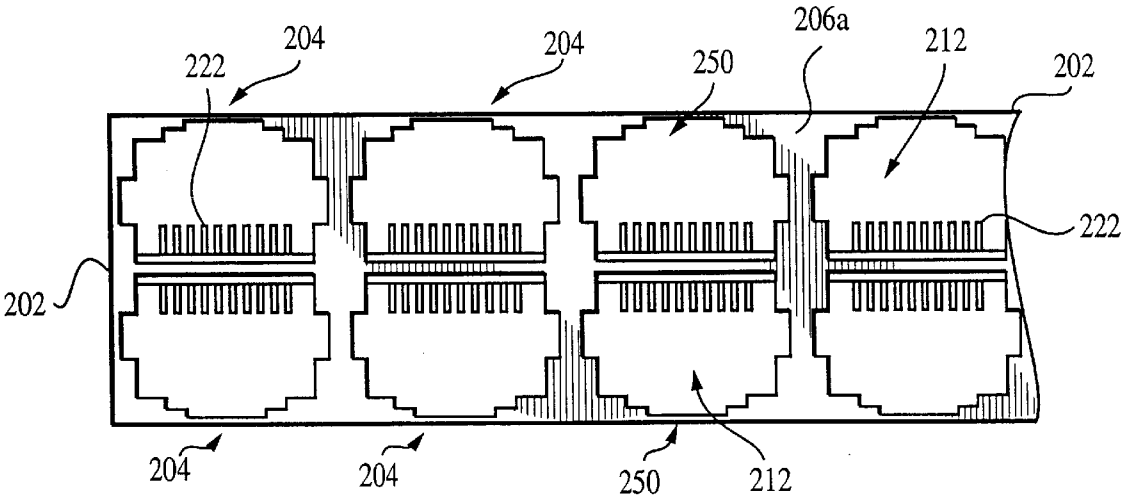
FIG. 2*c* is a front plan view of the connector housing used in the connector assembly of FIG. 2*a*.

Referring now to FIGS. 2*a*–2*c*, a first embodiment of the connector assembly of the present invention is described. As shown in FIGS. 2*a*–2*c*, the assembly 200 generally comprises a connector housing element 202 having a plurality of individual connectors 204 formed therein. Specifically, the connectors 204 are arranged in the illustrated embodiment in side-by-side row fashion within the housing 202 such that two rows 208, 210 of connectors 204 are formed, one disposed atop the other. The front walls 206*a* of each individual connector 204 are further disposed parallel to one another and generally coplanar, such that modular plugs (FIG. 2*a*) may be inserted into the plug recesses 212 formed in each connector 204 simultaneously without physical interference. The plug recesses 212 are each adapted to receive one modular plug (not shown) having a plurality of electrical conductors disposed therein in a predetermined array, the array being so adapted to mate with respective conductors 220*a* present in each of the recesses 212 thereby forming an electrical connection between the plug conductors and connector conductors 220*a*, as described in greater detail below. The connector housing element 202 is in the illustrated embodiment electrically non-conductive and is formed from a thermoplastic (e.g. PCT Thermx, IR compatible, UL94V-0), although it will recognized that other materials, polymer or otherwise, may conceivably be used. An injection molding process is used to form the housing element 202, although other processes may be used, depending on the material chosen. The selection and manufacture of the housing element is well understood in the art, and accordingly will not be described further herein.

Also formed generally within the recess 212 of each connector 204 in the housing element 202 are a plurality of grooves 222 which are disposed generally parallel and oriented vertically within the housing 202. The grooves 222 are spaced and adapted to guide and receive the aforementioned conductors 220 used to mate with the conductors 216 of the modular plug. The conductors 220 are formed in a predetermined shape and held within on of a plurality of electronic component packages 230, 232 (see FIG. 5), the latter also mating with the housing element 202 as shown in FIG. 2*c*. Specifically, the housing element 202 includes a plurality of cavities 234 formed in the back of respective connectors 204 generally adjacent to the rear wall of each connector 204, each cavity 234 being adapted to receive the component packages 230, 232 in sequential order. The cavities 234 are also sized in depth by approximately the thickness of two of the component packages 230, 232 such that the component packages sit in front-and-back order, the bottom row package 232 sitting in front (i.e, closer to the front face of the connector assembly) than the top row package 230. Each cavity 234 is positioned generally within the lower row of connectors in the housing element 202, while the upper conductors 220*a* from the top row package occupy the upper portion 235 of each cavity 234, thereby allowing electrical separation between the upper conductors 220*a* of each package 230, 232. The upper conductors 220*a* of the component packages are deformed such that when the package 230, 232 is inserted into its respective cavity 234, the upper conductors 220*a* are received within the grooves 222, maintained in position to mate with the conductors of the modular plug when the latter is received within the plug recess 212, and also maintained in electrical separation by the separators 223 disposed between and defining the grooves 222.

The component packages 230, 232 are retained within their cavities 234 substantially by way of respective latch mechanisms 233 which are molded into the housing element 202 and which project rearward from the central portion of the housing element. In the illustrated embodiment, the latch mechanisms 233 each comprise an elongated, flattened and somewhat flexible member having a latch protrusion 239 disposed at the distal end of the latch member 237. The protrusion 239 cooperates with a corresponding recess or detent 243 formed in the upper surface of the top row component package 230, thereby retaining the package 230 in place when the latter is positioned within the cavity 234. A set of lands 245 and corresponding grooves 247 are formed on the interior side walls 247 of each cavity 234 and the outer side walls 249 of each component package 230, 232, respectively, such that each package 230, 232 is properly aligned and precluded from dislocation when the latter are installed in the cavity 234. Hence, the combination of the lands and grooves 245, 247 and the latch mechanisms 233 securely maintain the component packages in the desired alignment and position when the device 200 is assembled.

It will be recognized, however, that any number of different arrangements for aligning and securing the component packages 230, 232 within the housing element 202 may be used, including friction, adhesives, or even other types of latch mechanisms of the type well known in the mechanical arts. The illustrated embodiment, however, has the advantages of, inter alia, ease of assembly, rigidity and the ability to be disassembled if desired, such as if it is desired to swap out or replace a single component package.

It is noted that while the embodiment illustrated in FIGS. 2*a*–2*c* includes component packages which have pairs of conductor sets 220*a*, 220*b* in each package (i.e., four sets of conductors per package), other configurations may be used. For example, the invention may be configured with an individual component package 230, 232 per individual connector 204, or alternatively with more than two complete sets of connector conductors 200*a*, 220*b* per package. As an alternate, the conductors 220*a*, 220*b* for all connectors 204 in the top housing row may be included within a single component package (not shown) which spans the width of the entire connector housing 202. Many other such alternatives are possible and considered to fall within the scope of the invention disclosed herein.

It will also be recognized that positioning or retaining elements (e.g., "contour" elements, as described in U.S. Pat. No. 6,116,963 entitled "Two Piece Microelectronic Connector and Method" issued Sep. 12, 2000, and assigned to the Assignee hereof) may optionally be utilized as part of the housing element 202 of the present invention. These positioning or retaining elements are used, inter alia, to position the individual upper conductors 220*a* with respect to the modular plug(s) received within the recess(es) 212, and thereby provide a mechanical pivot point or fulcrum for the upper conductors 220*a*. Additionally or in the alternative, these elements may act as retaining devices for the conductors 220*a* and any associated package 230, 232, thereby providing a frictional retaining force which opposes removal of the package and conductors from the housing 202. The construction and operation of such "contour" elements are described in U.S. Pat. No. 6,116,963 entitled "Two Piece Microelectronic Connector and Method" issued Sep. 12, 2000, and assigned to the Assignee hereof, which is incorporated herein by reference in its entirety.

Figure 6:
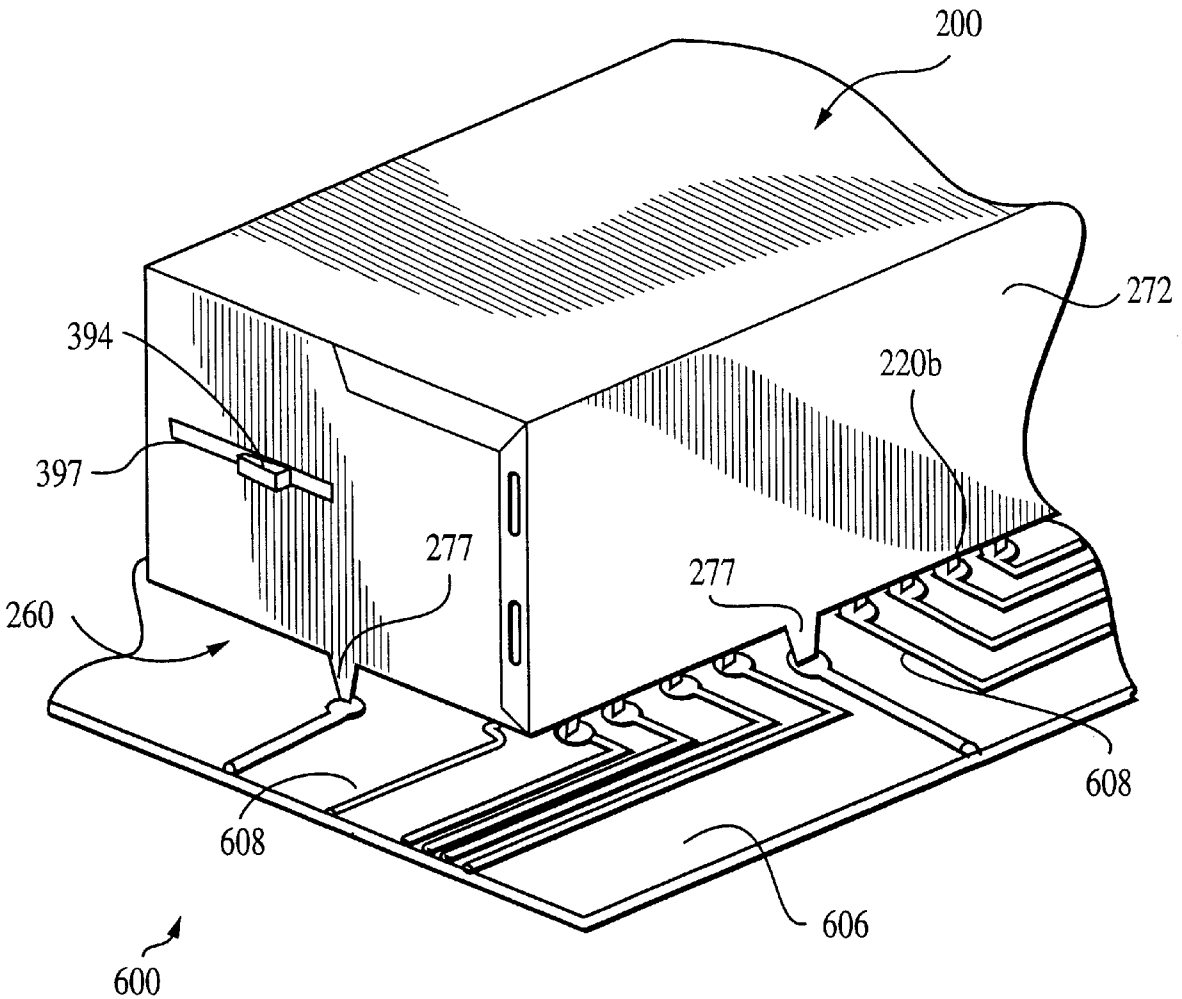
FIG. 6 is a perspective view of the connector assembly of the present invention, mounted on a typical substrate (PCB) to form an electronic assembly.

In the illustrated embodiment, the two rows of connectors 208, 210 are disposed relative to one another such that the upper conductors 220*a* of the packages 230 associated with the top row 208 are different in shape and length than those associated with the packages 232 for the bottom row 210. This difference in shape and length is largely an artifact of having the distal ends 229 of the lower conductors 220*b* for each of the co-linear packages 230, 232 received within the substrate shield 260 and terminate in coplanar fashion on the bottom surface of the connector assembly 200, thereby allowing mating to a flat component or substrate such as a PCB (see. FIG. 6).

Figure 2D:
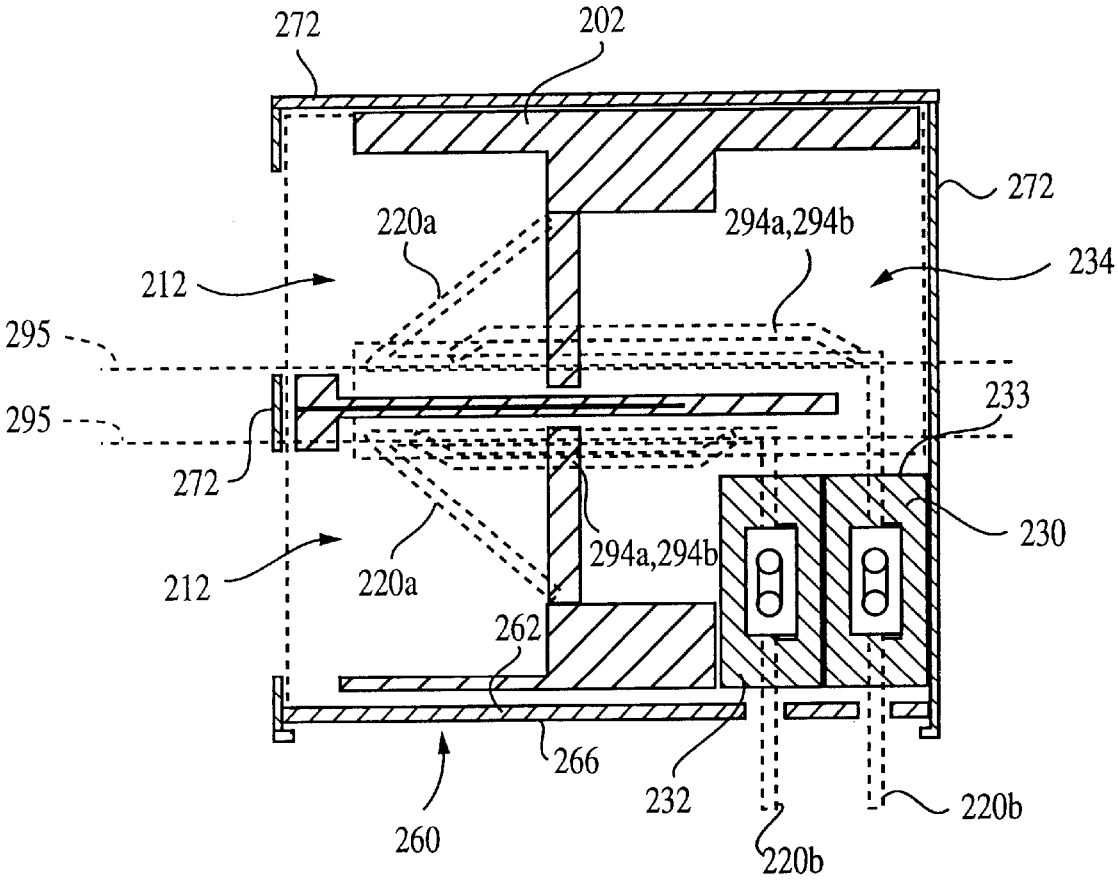
FIG. 2*d* is a cross-sectional view of the exemplary connector assembly of FIG. 2*b* taken along line 2—2.

Also in the illustrated embodiment, two conductors 294*a*, 294*b* of the upper conductors 220*a* of each connector are displaced out of the plane 295 containing the other conductors, as shown in FIG. 2*d*. These two conductors 294*a*, 294*b* are the "transmit" and "receive" conductors in the present embodiment, although it will be recognized that conductors with other functions may benefit from the configuration described herein. The aforementioned displacement is provided for the transmit and receive terminals of each connector in order to eliminate or reduce the electronic "crosstalk" between these conductors 294*a*, 294*b* and the remaining upper conductors of that same connector. Specifically, as the length of the upper conductors 220*a* grows longer, the associated capacitance also increases, and hence the opportunity for cross-talk. The displacement of a portion of each conductor out of the common plane 295 in the present invention adds more distance between the two conductors 294*a*, 294*b* and the other conductors of that connector, thereby reducing the field strength and accordingly the cross-talk there between. It is noted, however, that while the present embodiment utilizes a vertical displacement of the conductors 294*a*, 294*b* over a substantial portion of their effective length, other techniques may be used, such as providing a shielding element between the two conductors 294*a*, 294*b* and the other conductors in the connector, or moving the two conductors 294*a*, 294*b* laterally (i.e., within the common plane 295) away from the others for a portion of their run. Other approaches may also be used, such approaches being known to those of ordinary skill.

Figure 2E:
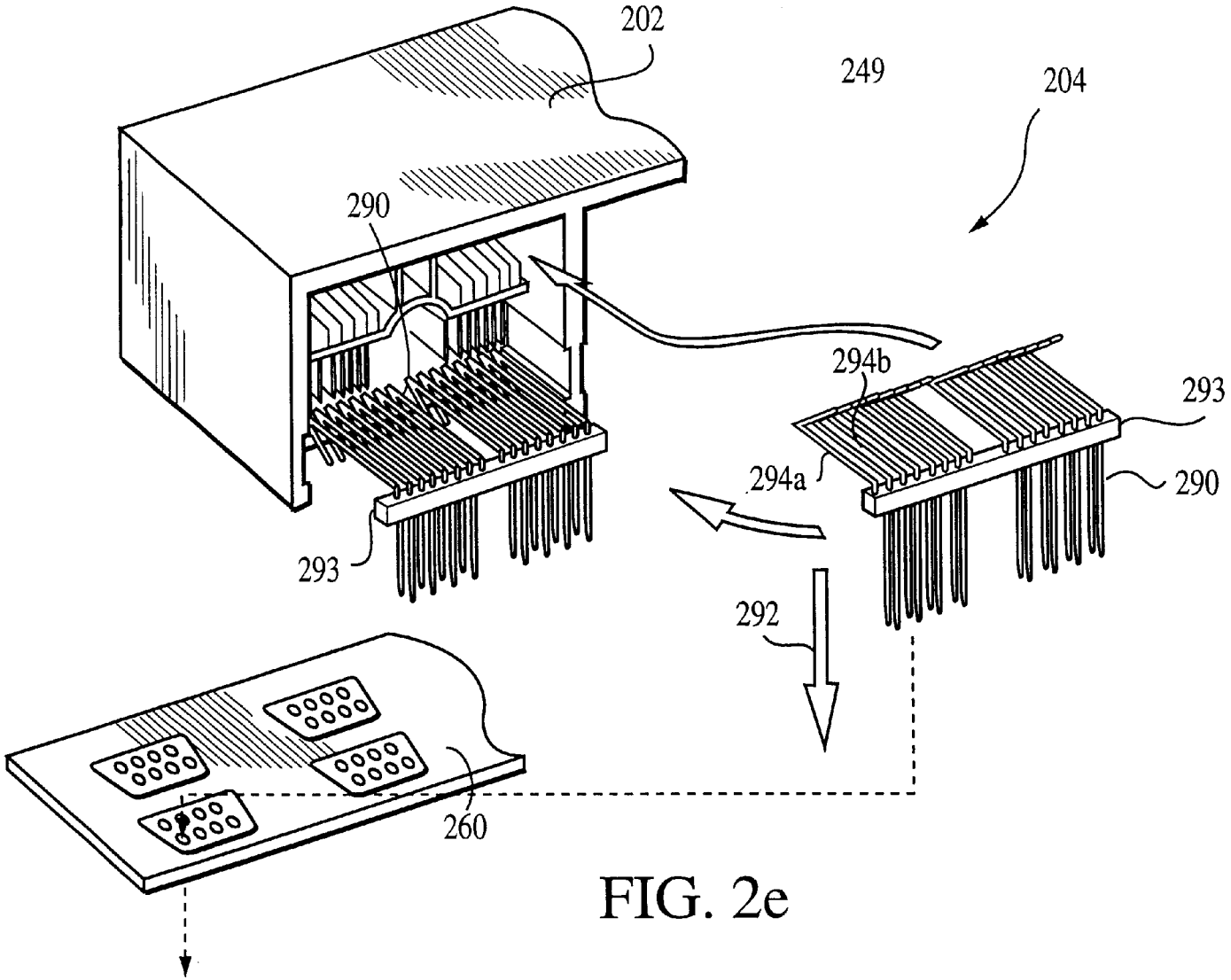
FIG. 2*e* is a rear perspective view of an alternate embodiment of the connector assembly of the invention, wherein the component packages are replaced with straight-run conductors with molded carriers.
Figure 5:
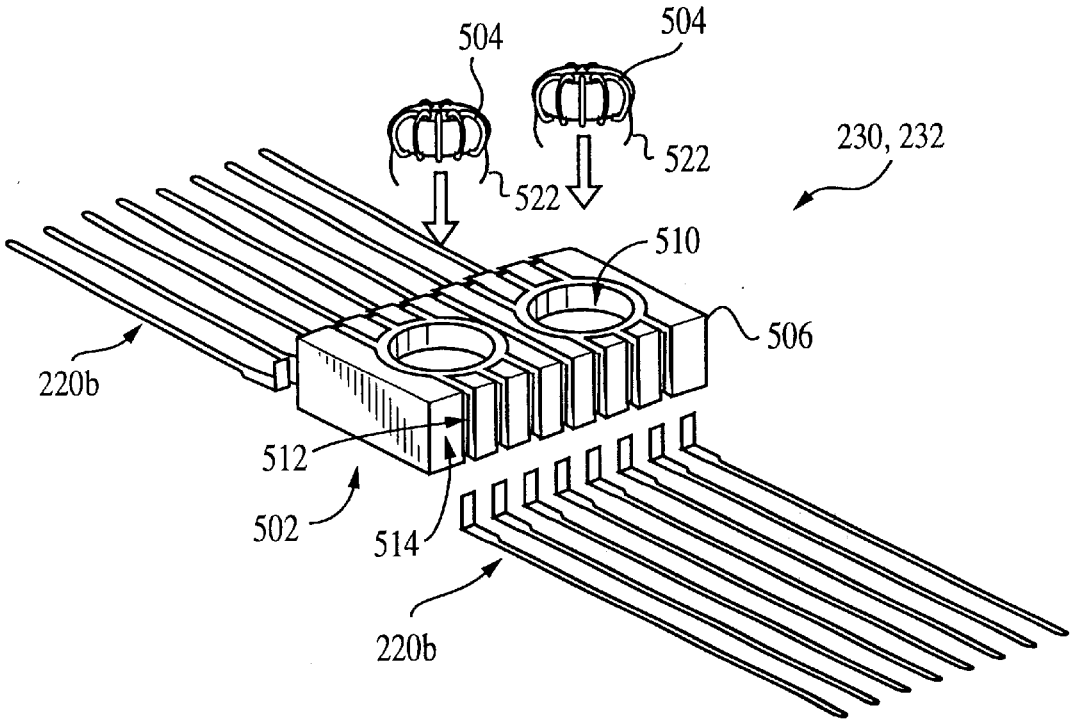
FIG. 5 is an assembly view of one embodiment of an interlock base assembly optionally used in conjunction with the invention.

It is further noted that while the embodiment of FIGS. 2*a*–2*c* includes top and bottom row connector component packages 230, 232 as described herein with respect to FIG. 5, all or a portion of such packages are optional, and may be eliminated from the design if not electrically required as shown in the alternative embodiment of FIG. 2*e*. For example, in applications where no signal filtering or voltage transformation is required, the electronic components within the package are obviated, and "straight run" conductors 290 may be used to replace the packages 230, 232 and their associated upper and lower conductors 220*a*, 220*b*. As shown in FIG. 2*d*, the straight-run conductors 290 emerge from the rear portion of each connector 204 and subsequently project in a downward direction 292 and ultimately through the substrate shield 260 for termination to the PCB or other external device. The conductors 290 are optionally held within an overmolded "carrier" 293 for added rigidity and alignment. It will be appreciated, however, that configurations other than that shown in FIG. 2*d* may be used, such as for example utilizing guide slots formed in the front and rear walls of a insulating separator on each of the sets of conductors (not shown).

It is further noted that while the embodiment of FIGS. 2*a*–2*c* comprises two rows 208, 210 of four connectors 204 each (thereby forming a 2 by 4 array of connectors), other array configurations may be used. For example, a 2 by 2 array comprising two rows of two connectors each could be substituted. Alternatively, a 2 by 8 arrangement could be used. As another alternative, three rows of four connectors per row (i.e., 3 by 4) may be used. As yet another alternative, an asymmetric arrangement may be used, such as by having two rows with an unequal number of connectors in each row (e.g., two connectors in the top row, and four connectors in the bottom row). The plug recesses 212 (and front faces 206*a*) of each connector also need not necessarily be coplanar as in the embodiment of FIGS. 2*a*–2*c*. Furthermore, certain connectors in the array need not have electronic component packages, or alternatively may have different components within the packages than other connectors in the same array. Many other permutations are possible consistent with the invention; hence, the embodiments shown herein are merely illustrative of the broader concept.

The rows 208, 210 of the embodiment of FIGS. 2*a*–2*c* are oriented in mirror-image fashion, such that the latching mechanism 250 for each connector 204 in the top row 208 is reversed or mirror-imaged from that of its corresponding connector in the bottom row 210. This approach allows the user to access the latching mechanism 250 (in this case, a flexible tab and recess arrangement of the type commonly used on RJ modular jacks, although other types may be substituted) of both rows 208, 210 with the minimal degree of physical interference. It will be recognized, however, that the connectors within the top and bottom rows 208, 210 may be oriented identically with respect to their latching mechanisms 250, such as having all the latches of both rows of connectors disposed at the top of the plug recess 212, if desired.

The connector assembly 200 of the invention further comprises a shield substrate 260 which is disposed in the illustrated embodiment on the bottom face of the connector assembly 200 adjacent to the PCB or substrate to which the assembly 100 is ultimately mounted (FIG. 6). The shield substrate comprises, in the illustrated embodiment, at least one layer of fiberglass 262 upon which a layer of tin-plated copper or other metallic shielding material 266 is disposed. The exposed portions of both the fiberglass 262 and metallic shield may also be optionally coated with a polymer for added stability and dielectric strength. The substrate 260 further includes a plurality of terminal pin perforation arrays 268 formed at predetermined locations on the substrate 260 with respect to the lower conductors 220*b* of each component package 230, 232 such that when the connector assembly 200 is fully assembled, the lower conductors 220*b* penetrate the substrate 260 via respective ones of the terminal pin arrays 268. Provision for a pin or other element (not shown) connecting the metallic shield 266 to the external noise shield 272 is also provided. In this manner, the shield elements 266, 272 are electrically coupled and ultimately grounded so as to avoid accumulation of electrostatic potential or other potentially deleterious effects.

In the illustrated embodiment, the metallic shield layer 266 is etched or removed from the area 270 immediately adjacent and surrounding the terminal pin arrays 268, thereby removing any potential for undesirable electrical shorting or conductance in that area. Hence, the lower conductors 220*b* of each connector penetrate the substrate and only contact the non-conductive fiberglass layer 262 of the substrate 260, the latter advantageously providing mechanical support and positional registration for the lower conductors 220*b*. It will be recognized that other constructions of the substrate shield 260 may be used, however, such as two layers of fiberglass with the metallic shield layer 266 "sandwiched" between, or even other approaches.

The metallic shield layer 266 of the substrate 260 acts to shield the bottom face of the connector assembly 200 against electronic noise transmission. This obviates the need for an external metallic shield encompassing this portion of the connector assembly 200, which can be very difficult to execute from a practical standpoint since the conductors 220*b* occupy this region as well. Rather, the substrate 260 of the present invention provides shielding of the bottom portion of the connector assembly 200 with no risk of shorting from the lower conductors 220*b* to an external shield, while also providing mechanical stability and registration for the lower conductors 220*b*.

Figure 2F:
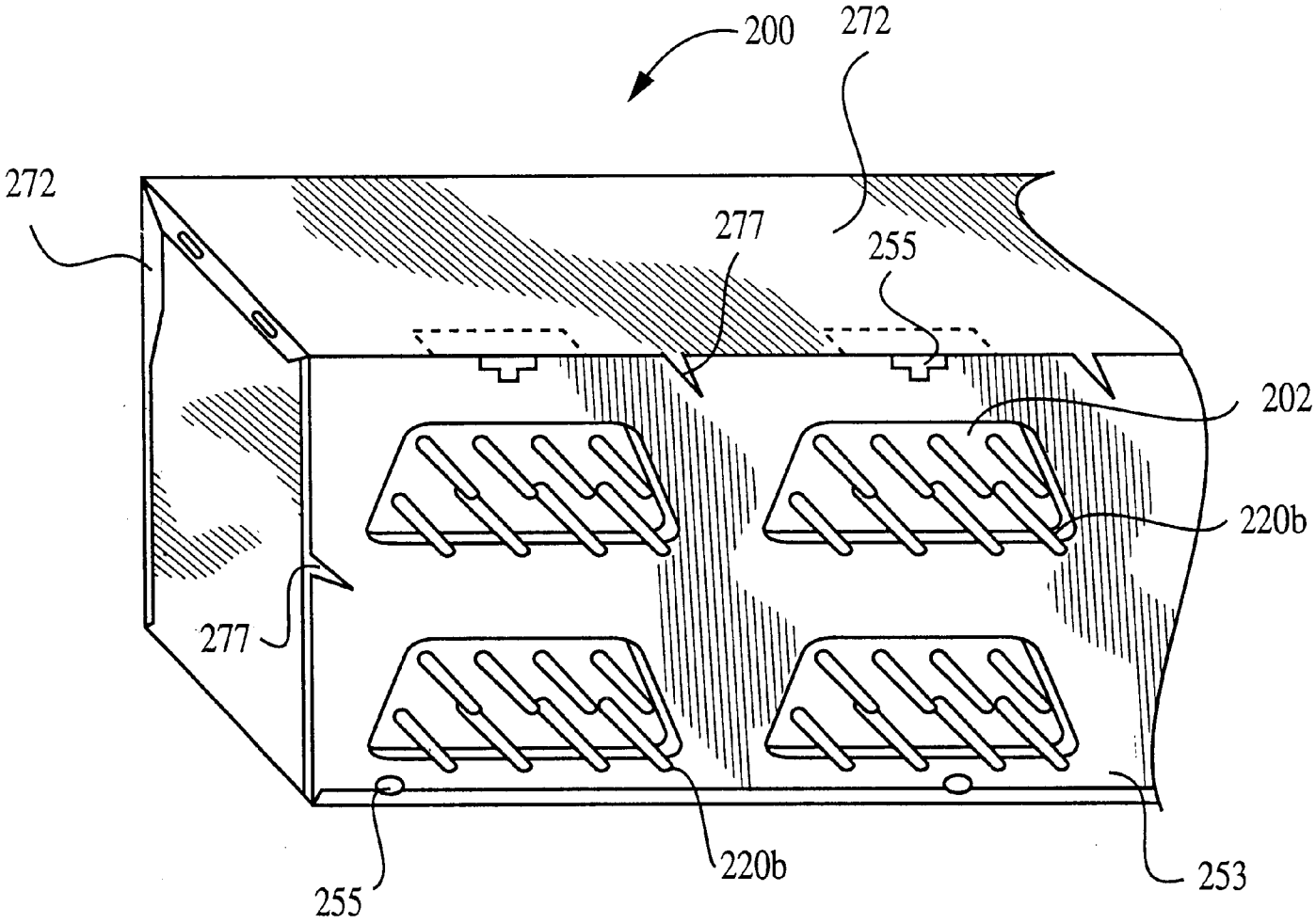
FIG. 2*f* is a bottom perspective view of an alternate embodiment of the connector assembly of the invention, illustrating the use of a single layer metallic shield substrate.

In an alternate embodiment to that shown in FIGS. 2*a*–2*c*, the shielded substrate 260 may comprise a single layer 253 of metallic shielding material (such as copper alloy; approximately 0.005 in. thick), which has been formed to cover substantially all of the bottom surface of the connector assembly, as shown in FIG. 2*f*. As with the shield substrate of FIGS. 2*a*–2*c*, the portion of the single metallic layer immediately adjacent the lower conductors 220*b* has been removed to eliminate the possibility of electrical shorting to the shield 253. The shield 253 is also soldered 255 or otherwise conductively joined to the external noise shield 272 (described below) to provide grounding for the former. The embodiment of FIG. 2*f* has the advantage of simplicity of construction and lower manufacturing cost, since the fabrication of the single layer metallic 253 is much simpler than its multi-layer counterpart of the embodiment shown in FIGS. 2*a*–2*c*.

The connector assembly 200 of FIGS. 2*a*–2*c* also includes an external noise shield 272 which is mounted over the connector housing 202 in a generally conformal manner as illustrated in FIG. 2*b*. The external shield 272 is of metallic construction, specifically 0.010 in. thick copper based alloy. In the illustrated embodiment, the external shield 272 is segmented into a plurality of interlocking planar sections 274*a*–*e* which when assembled encompass the majority of surface area of the connector assembly 200 (with the exception of the bottom surface 206*d* of the housing 202, and the modular plug recesses 212 of each connector 204). Hence, when the external shield 272 is combined with the substrate shield 260 previously described, electronic noise transmission across all six of the faces of the housing element is substantially mitigated or even eliminated. The external noise shield 272 further includes a plurality of ground "spikes" 277 disposed along the lower edges of the side and rear shield sections 274*b*–*d*, which mate with corresponding ground apertures or terminals on the PCB (not shown) for grounding of the shield. The construction and use of external metallic noise shield is swell known in the electrical arts, and accordingly is not described further herein.

Figure 3A:
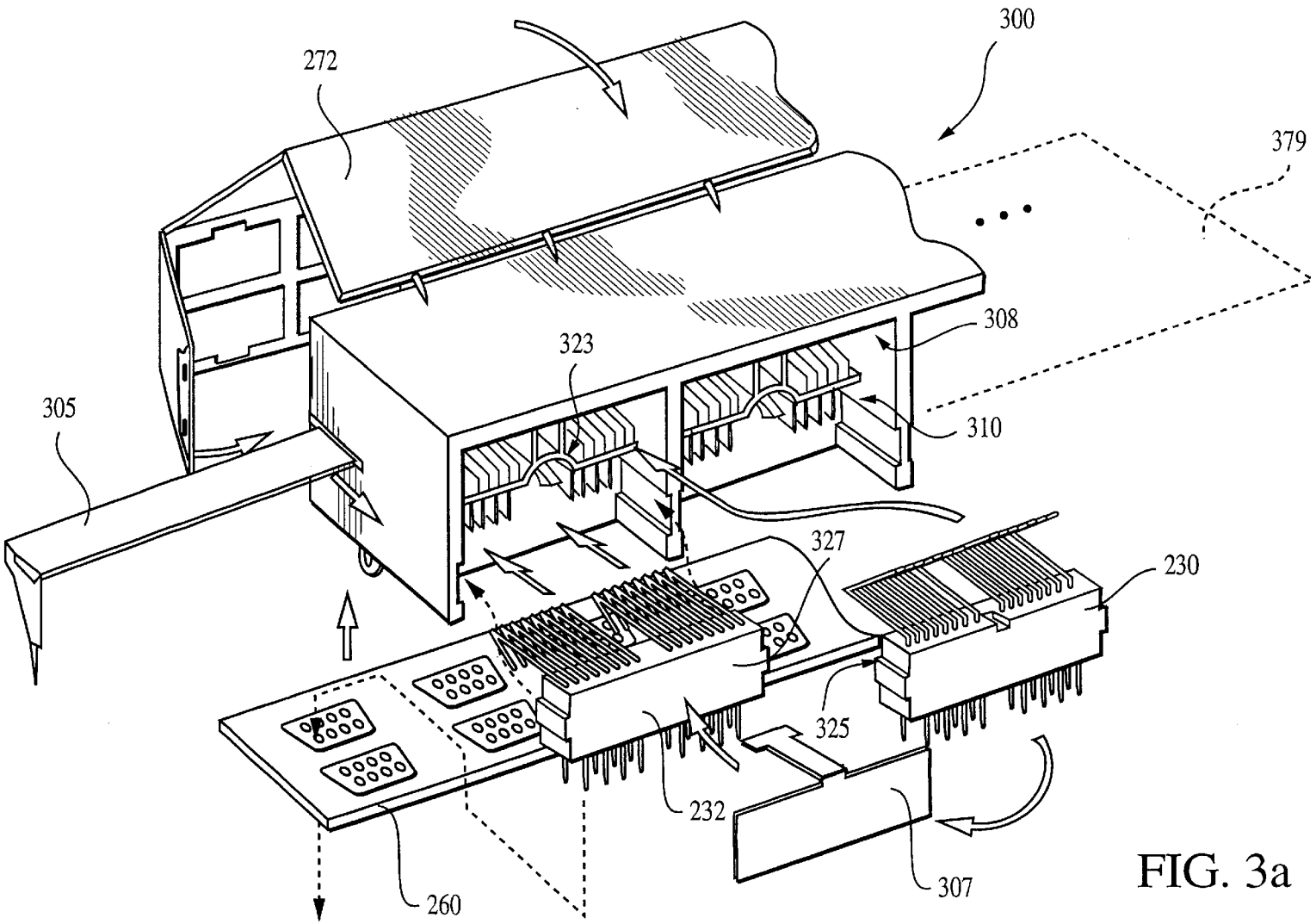
FIG. 3*a* is a rear assembly view of a second exemplary embodiment of the connector assembly of the invention, including top-to-bottom and front-to-back shielding elements.
Figure 3B:
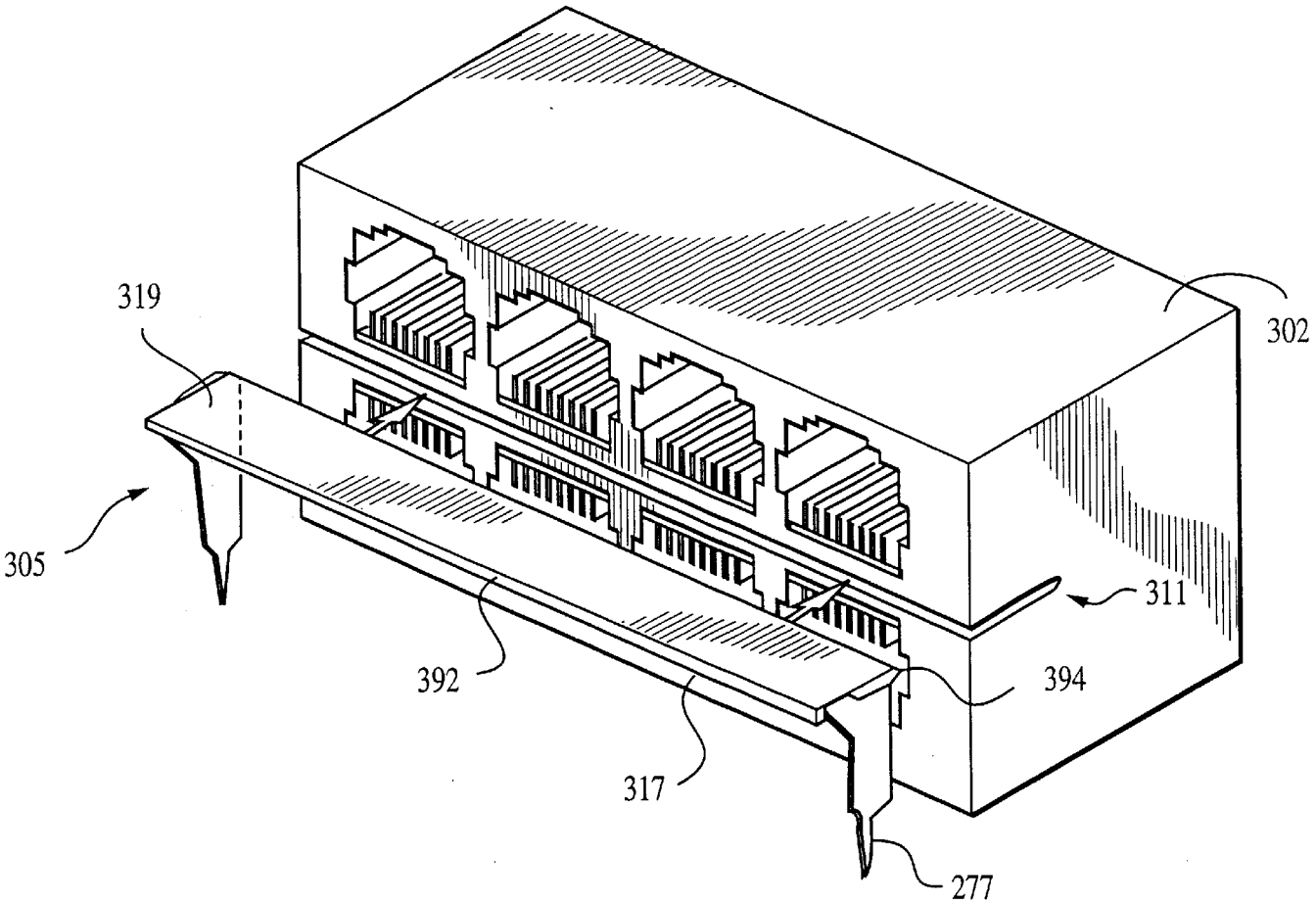
FIG. 3*b* is a front perspective view of the top-to-bottom shield and associated slot used in the connector assembly of FIG. 3*a*.
Figure 3C:
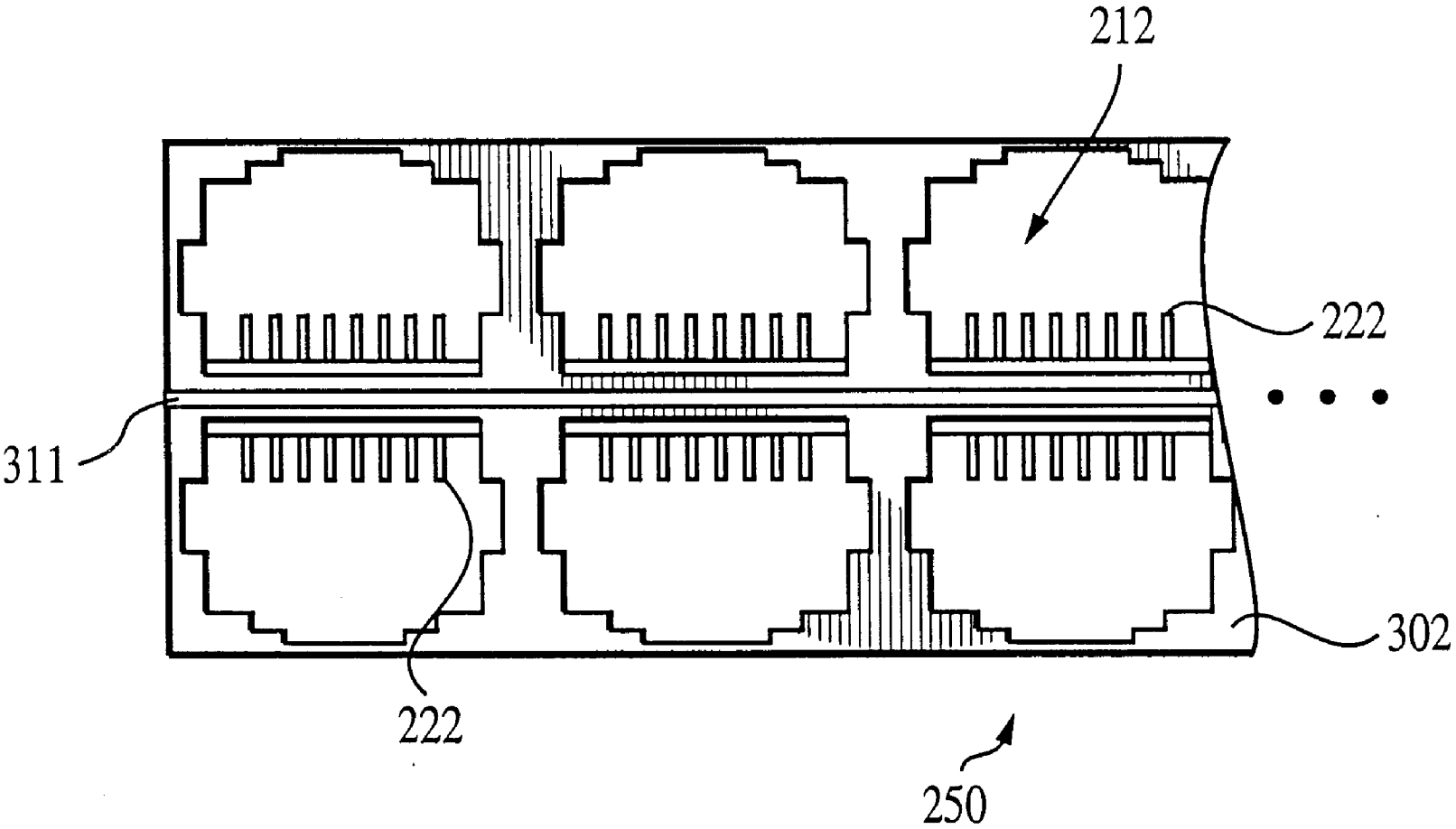
FIG. 3*c* is a front plan view of the connector housing of the assembly of FIG. 3*a*.

Referring now to FIGS. 3*a*–3*c*, a second embodiment of the connector assembly of the present invention is described. In this second embodiment 300, the connector assembly of FIGS. 2*a*–2*c* previously described is adapted to include (i) a top-to-bottom noise shield element 305, and (ii) a plurality of front-to-back shield elements 307 in order to further mitigate electronic noise transmission. While the substrate shield 260 and external shield 272 of the prior embodiment mitigate or eliminate noise transmitted across the six exterior faces of the connector assembly 200, the top-to-bottom noise shield element 305 and front-to-back shield elements 307 of the embodiment of FIG. 3 further reduce noise transmission by shielding the upper row of connectors 308 from the lower row 310, and the upper row component packages 230 from the lower row packages 232, respectively. In this fashion, noise is mitigated across effectively all significant interfaces in the assembly.

It is noted that the terms "top-to-bottom" and "front-to-back" as used herein are also meant to include orientations which are not purely horizontal or vertical, respectively, with reference to the plane 379 of the connector assembly. For example, one embodiment of the connector assembly of the invention (not shown) may comprise a plurality of individual connectors arranged in an array which is curved or non-linear with reference to a planar surface, such that the top-to-bottom noise shield would also be curved or non-linear to provide shielding between successive rows of connectors. Similarly, the front-to-back shield elements could be disposed in an orientation which is angled with respect to the vertical, or even disposed within the connector parallel to the side faces of the connector housing 202, depending on the orientation of the component packages 230, 232. Hence, the foregoing terms are in no way limiting of the orientations and/or shapes which the disclosed shield elements 305, 307 may take.

Similarly, while such shield elements 305, 307 are described herein in terms of a single, unitary component, it will be appreciated that either or both shield elements 305, 307 may comprise two or more sub-components that may be physically separable from each other. Hence, the present invention anticipates the use of "multi-part" shields.

The top-to-bottom shield element 305 in the illustrated embodiment (FIGS. 3*b* and 3*c*) is formed from a copper zinc alloy (260), temper H04, which is approximately 0.008 in. thick and plated with a bright 93%/7% tin-lead alloy (approximately 0.00008–0.00015 inch thick) over a matte nickel underplate (approximately 0.00005–0.00012 inch thick). However, other materials, constructions, and thickness values may be substituted depending on the particular application. The shield element 305 further includes two joints 394 disposed at either end of the element 305, which cooperate with two lateral slots 397 in the external shield 272 to couple the top-to-bottom shield element 305 to the external shield 272 after the connector assembly 300 has been fully assembled. The joints 394 are optionally soldered or otherwise in contact with the edges of the lateral slots in the external shield, thereby forming an electrically conductive path if desired. The shield element (or portions thereof) may also optionally be provided with a dielectric overcoat, such as a layer of Kapton™ polyimide tape.

The top-to-bottom shield element 305 is received within a groove or slot 311 formed in the front face 313 of the connector housing element 302 to a depth such that shielding between the top row 308 and bottom row 310 of the assembly 300 is accomplished. In the illustrated embodiment, the shield element 305 includes a retainer tab 392 which is formed by bending the outward edge 317 of the shield element 305 at an angle with respect to the plane 319 of the shield element at the desired location. This arrangement allows the shield element 305 to be inserted within the slot 311 to a predetermined depth, thereby reducing the potential for variation in the depth to which the shield element penetrates from assembly to assembly during manufacturing. It will be recognized, however, that other arrangements for positioning the top-to-bottom shield element 305 may be utilized, such as pins, detents, adhesives, etc., all of which are well known in the art.

Figure 3D:
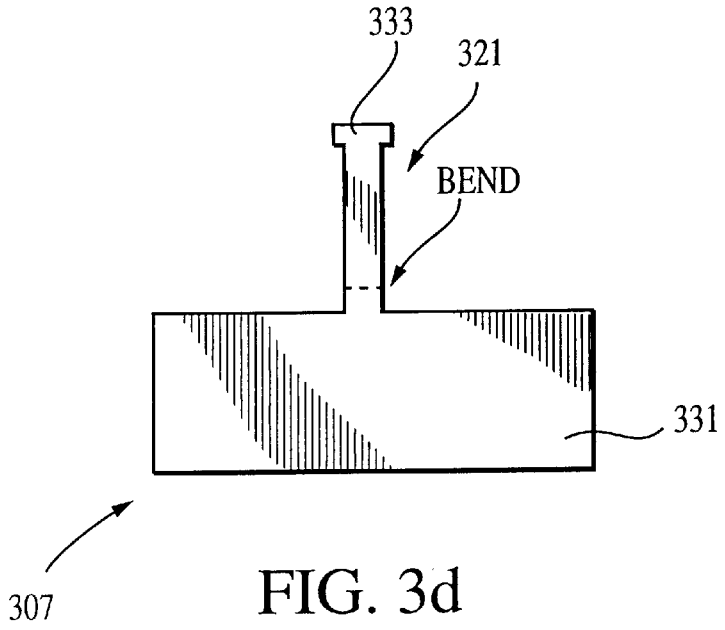
FIG. 3*d* is a top plan view of a front-to-back shield (prior to deformation) used in the connector assembly of FIG. 3*a*, showing the "T" shape thereof.

The front-to-back shield elements 307 are fabricated generally in the shape of a "T" as shown in FIG. 3*d*. The elongate portion 321 of each element 307 is received within a corresponding slot 323 which runs front-to-back on the housing 302 generally in the horizontal plane bisecting the housing 302 into top row 308 and bottom row 310. When the shield element 307 is installed, its planar component 331 is positioned in a vertical orientation and held in contact between the front surface 325 of the top row component package 230 and the rear surface 327 of the bottom row component package 232, thereby effectively separating the two packages with respect to radiated electronic noise. The elongate portion 321 of each shield element 307 is deformed roughly ninety (90) degrees from the planar component 331 and joined, such as by soldering, at its distal end 333 to the top-to-bottom shield element 305, thereby forming an electrical connection and common potential between the two elements.

The front-to-back shield elements 307 of the illustrated embodiment are fabricated from copper foil of the type well known in the art approximately 0.002–0.003 in. thick, although as with the top-to-bottom shield 305, other materials and thickness values may be used.

In addition to the substrate shield 260, external shield 272, top-to-bottom shield 305, and front-to-back shields 307, the connector assembly 300 of the invention may further be configured with inter-connector shields (not shown) disposed laterally between individual ones of the connectors 304 in the top row 308 and bottom row 310. Such inter-connector shields may formed as separate discrete elements which are inserted into slots formed in the connector housing 302 similar to that for the top-to-bottom shield 305 (except in vertical orientation), or alternatively as a film coating or layer disposed between the walls of the individual adjacent connectors 304 in a given row 308, 310 formed during manufacturing of the housing 302. Other configurations which laterally shield the connectors 304 are also possible consistent with the invention disclosed herein.

Figure 4A:
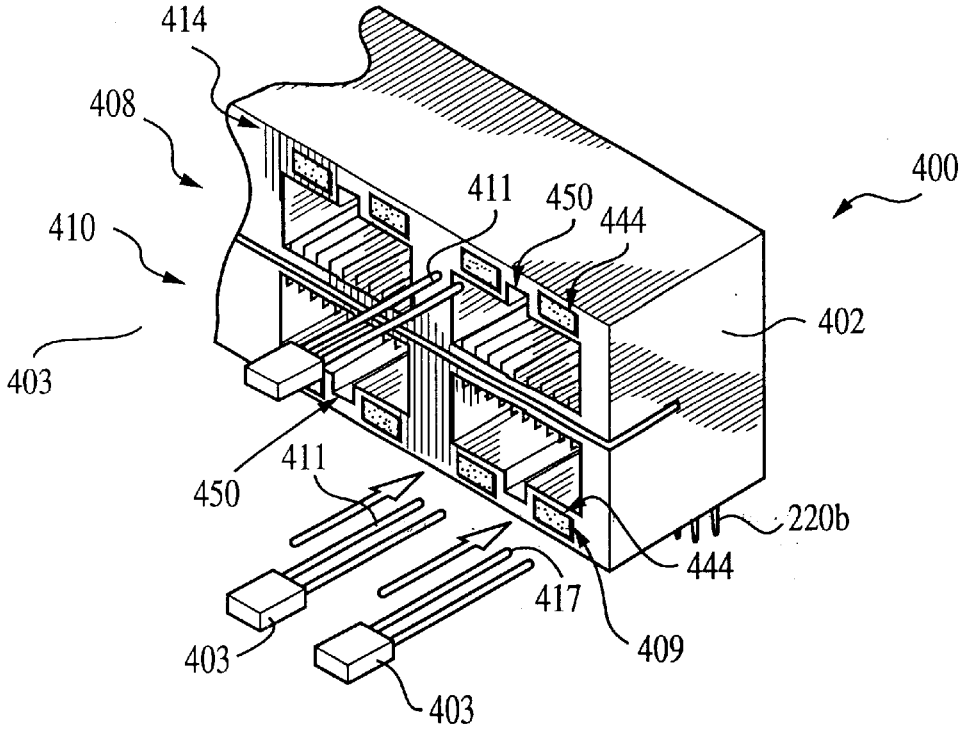
FIGS. 4*a* and 4*b* are partial assembly and cross-sectional views, respectively, of a third exemplary embodiment of the connector assembly of the invention, including light-emitting diodes.
Figure 4B:
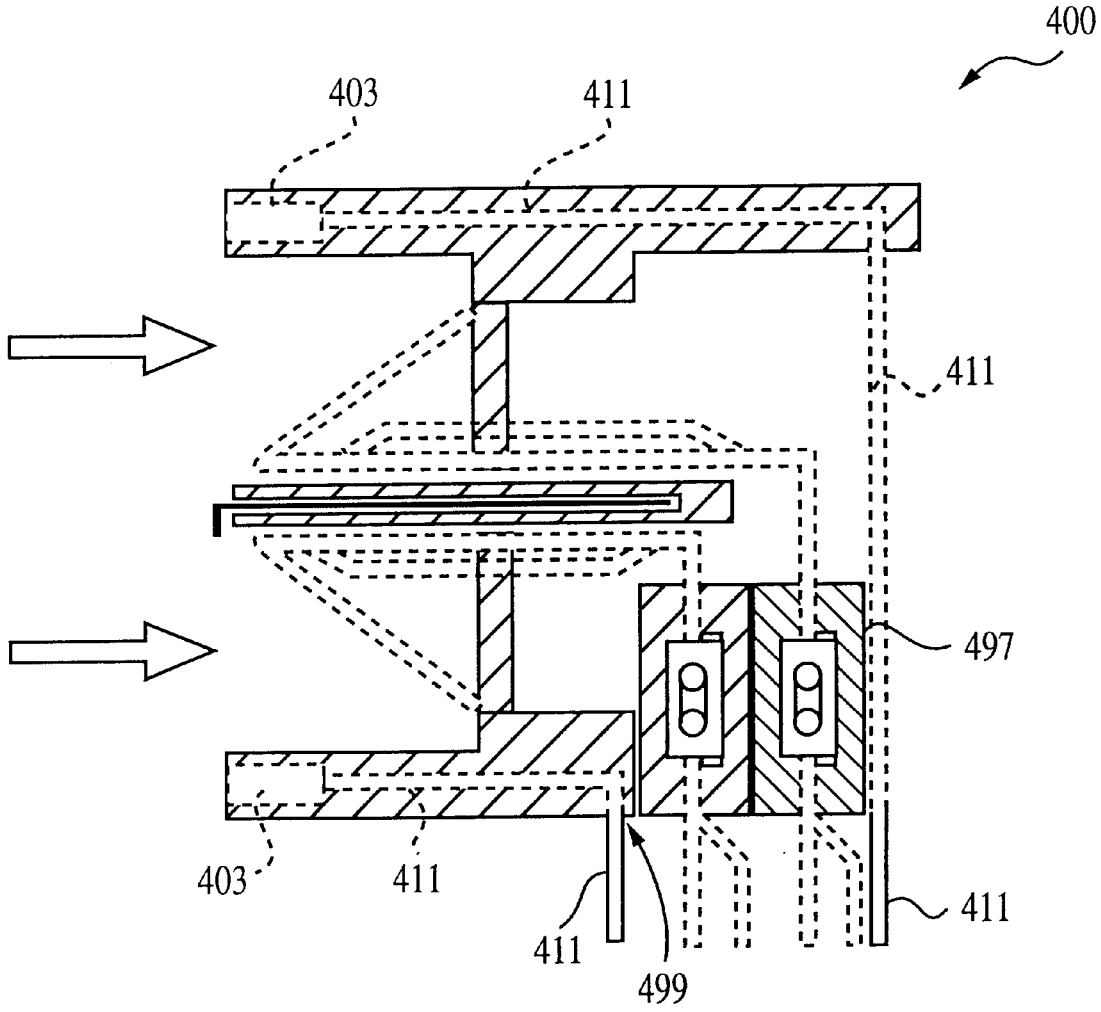
Figure 4C:
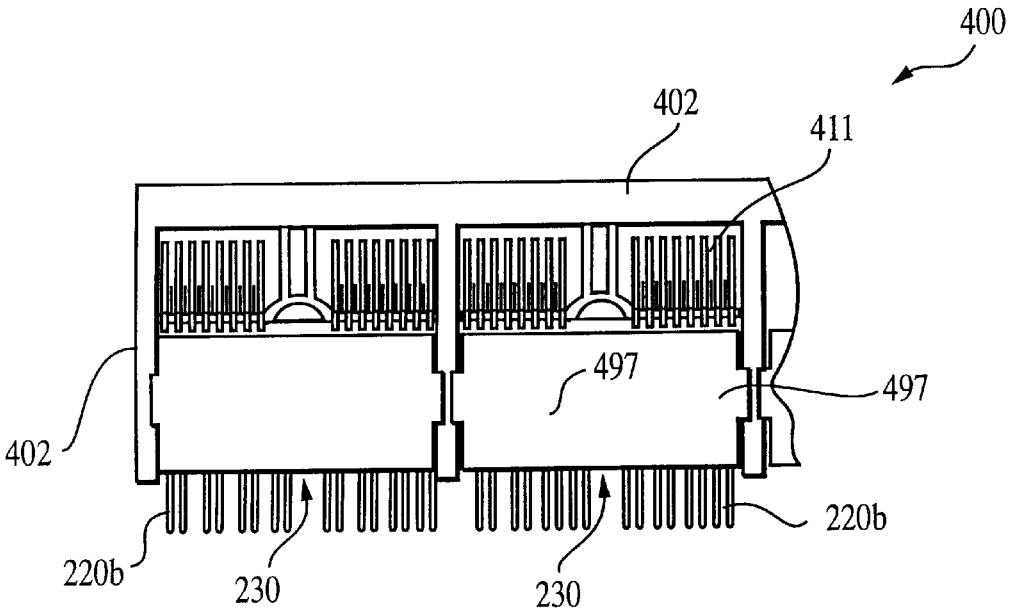
FIG. 4*c* is a partial rear plan view of the connector of FIGS. 4*a*–4*b*, illustrating the placement of the LED conductors in grooves formed in the rear face of the upper connector row component packages.

Referring now to FIGS. 4*a*–4*c*, yet another embodiment of the connector assembly of the present invention is described. As shown in FIGS. 4*a*–4*c*, the connector assembly 400 further comprises a plurality of light sources 403, presently in the form of light emitting diodes LEDs of the type well known in the art. The light sources 403 are used to indicate the status of the electrical connection within each connector, as is well understood. The LEDs 403 of the embodiment of FIGS. 4*a*–4*c* are disposed at the bottom edge 409 of the bottom row 410 and the top edge 414 of the top row 408, two LEDs per connector adjacent to and on either side of the modular plug latch mechanism 450, so as to be visible from the front face of the connector assembly 400. The individual LEDs 403 are, in the present embodiment, received within recesses 444 formed in the front face of the housing element 402. The LEDs each include two conductors 411 which run from the rear of the LED to the rear portion of the connector housing element 402 generally in a horizontal direction within lead channels 447 formed in the housing element 402. The LED conductors 411 are deformed or bent at such an angle towards their distal ends 417 such that they can penetrate through and emerge from corresponding apertures 419 formed in the shield substrate 460, generally parallel to the lower conductors 220*b* from the top and bottom row component packages 230, 232, thereby forming a conductor array which facilitates termination to a PCB or other external component. As shown in FIG. 4*c*, the LED conductors 411 are frictionally received in complementary vertical grooves 497 formed in the rear face of the component packages 230 associated with the upper row of connectors. These grooves 497 help retain the conductors 411 in relative position to the lower conductors 220*b* of the package 230, thereby facilitating insertion through the substrate shield 460.

Similarly, a set of complementary grooves 499 are formed terminating on the bottom face of the housing 402 coincident with the conductors 411 for the LEDs of the bottom row of connectors. These allow the LED conductors to be received within their respective recesses 444, and upon emergence from the rear end of the recess 444, be deformed downward as shown in FIG. 4*b* to be frictionally received within their respective grooves 499. The lower component package 232 is then inserted into the housing 402, the front face of the lower package 232 contacting the rearward projections of the walls of the grooves 499, thereby forming a closed channel for the conductors 411 of the lower row connector LEDs, and maintaining them in the proper position (along with the frictional effect of the recesses 444 and the grooves 499).

The recesses 444 formed within the housing element 402 each encompass their respective LED when the latter is inserted therein, and securely hold the LED in place via friction between the LED 403 and the inner walls of the recess (not shown). Alternatively, a looser fit and adhesive may be used, or both friction and adhesive. As yet another alternative, the recess 444 may comprise only two walls, with the LEDs being retained in place primarily by their conductors 411, which are frictionally received within grooves formed in the adjacent surfaces of the connector housing. This latter arrangement is illustrated most clearly in U.S. Pat. No. 6,325,664 entitled "Shielded Microelectronic Connector with Indicators and Method of Manufacturing" issued Dec. 4, 2001, and assigned to the Assignee hereof, which is incorporated by reference herein in its entirety. As yet another alternative, the external shield element 272 may be used to provide support and retention of the LEDs within the recesses 444, the latter comprising three-sided channels into which the LEDs 403 fit. Many other configurations for locating and retaining the LEDs in position with respect to the housing element 402 may be used, such configurations being well known in the relevant art.

The two LEDs 403 used for each connector 404 radiate visible light of the desired wavelength(s), such as green light from one LED and red light from the other, although multi-chromatic devices (such as a "white light" LED), or even other types of light sources, may be substituted if desired. For example, a light pipe arrangement such as that using an optical fiber or pipe to transmit light from a remote source to the front face of the connector assembly 400 may be employed. Many other alternatives such as incandescent lights or even liquid crystal (LCD) or thin film transistor (TFT) devices are possible, all being well known in the electronic arts.

The connector assembly 400 with LEDs 403 may further be configured to include noise shielding for the individual LEDs if desired. Note that in the embodiment of FIGS. 4*a*–4*b*, the LEDs 403 are positioned inside of (i.e., on the connector housing side) of the external noise shield 272. If it is desired to shield the individual connectors 404 and their associated conductors and component packages from noise radiated by the LEDs, such shielding may be included within the connector assembly 400 in any number of different ways. In one embodiment, the LED shielding is accomplished by forming a thin metallic (e.g., copper, nickel, or copper-zinc alloy) layer on the interior walls of the LED recesses 444 (or even over the non-conductive portions of LED itself) prior to insertion of each LED. In a second embodiment, a discrete shield element (not shown) which is separable from the connector housing 402 can be used, each shield element being formed so as to accommodate it's respective LED and also fit within its respective recess 444. In yet another embodiment, the external noise shield 272 may be fabricated and deformed within the recesses 444 so as to accommodate the LEDs 403 on the outer surface of the shield, thereby providing noise separation between the LEDs and the individual connectors 404. This latter approach is illustrated most clearly in U.S. Pat. No. 6,325,664 entitled "Shielded Microelectronic Connector with Indicators and Method of Manufacturing" previously incorporated herein. Myriad other approaches for shielding the connectors 404 from the LEDs may be used as well if desired, with the only constraint being sufficient electrical separation between the LED conductors and other metallic components on the connector assembly to avoid electrical shorting.

FIG. 5 illustrates one exemplary embodiment of the electronic component packages 230, 232 used in conjunction with the embodiments of FIGS. 2*a*–2*c*, 3*a*–3*b*, and 4*a*–4*b*. In the illustrated embodiment, the component packages 230, 232 each generally comprise upper and lower conductor sets 220*a*, 220*b*, an interlock base assembly 502, and one or more electronic components 504 disposed within the interlock base 502. The electronic components 504 used in the packages 230, 232 may include any number of different devices such as, for example, toroidal core transformers, filtering components such as inductive reactors (i.e., "choke coils"), inductors, capacitors, or even integrated circuit (IC) devices, which are used to condition an electrical signal transmitted via the associated connector. As used herein, the term "condition" shall be understood to include, but not be limited to, signal voltage transformation, filtering, current limiting, sampling, processing, and time delay. An exemplary toroid core transformer is disclosed in co-pending U.S. patent application Ser. No. 09/661,628 entitled "Advanced Electronic Microminiature Coil and Method of Manufacturing" filed Sep. 13, 2000, and assigned to the assignee hereof, which is incorporated herein by reference in its entirety.

As is well understood in the electronic component arts, the interlock base 502 comprises an insulating base element 506 having one or more component recesses 510 formed therein, as well as a plurality of lead channels 512 formed in the sidewall areas 514 of the base element 506. The electronic component(s) 504 is/are disposed within the recesses 510, and the conductors 522 of the component(s) 504 routed to selected ones of the lead channels 512 for electrical termination to the upper and lower conductors 220*a*, 220*b* as required to achieve electrical continuity through the component(s) 504. The base assembly 502 is further optionally encapsulated within an epoxy or other suitable material for mechanical stability and protection, as is well known in the electronic arts. The construction of interlock base assemblies such as that shown in FIG. 5 are described in detail in, inter alia, U.S. Pat. No. 5,105,981 entitled "Electronic Microminature Packaging and Method", issued May 14, 1991, and assigned to the Assignee hereof. It will be recognized, however, that while an interlock base is illustrated in the embodiment of FIG. 5, other approaches for electrically connecting and mechanically supporting such electronic components may be used consistent with the invention. For example, the conductors 522 of the electronic component(s) 504 may be terminated directly to the upper and lower conductors 220*a*, 220*b* of the package, such as by wire-wrapping into a notch formed in the conductors 220*a*, 220*b*, or wire-wrapping and soldering. The electronic component(s) 504 and conductors 220*a*, 220*b* may then be over-molded with an epoxy or other insulating encapsulant to preserve the physical relationship of the components. As yet another alternative, the component packages 230, 232 may comprise IC devices whose package leads are sized and formed in the shape of the upper and lower conductors 220*a*, 220*b* of the connector assembly of FIGS. 2*a*–2*c*. In this fashion, each IC device plugs directly into the connector housing 202, with the leads of the IC device acting as the upper and lower conductors 220*a*, 220*b*.

FIG. 6 illustrates the connector assembly of FIGS. 2*a*–2*c* mounted to an external substrate, in this case a PCB. As shown in FIG. 6, the connector assembly 200 is mounted such that the lower conductors 220*b* penetrate through respective apertures 602 formed in the PCB 606. The lower conductors are soldered to the conductive traces 608 immediately surrounding the apertures 602, thereby forming a permanent electrical contact there between. Note that while a conductor/aperture approach is shown in FIG. 6, other mounting techniques and configurations may be used. For example, the lower conductors 220*b* may be formed in such a configuration so as to permit surface mounting of the connector assembly 200 to the PCB 606, thereby obviating the need for apertures 602. As another alternative, the connector assembly 200 may be mounted to an intermediary substrate (not shown), the intermediary substrate being mounted to the PCB 606 via a surface mount terminal array such as a ball grid array (BGA), pin grid array (PGA), or other non-surface mount technique. The footprint of the terminal array is reduced with respect to that of the connector assembly 200, and the vertical spacing between the PCB 606 and the intermediary substrate adjusted such that other components may be mounted to the PCB 606 outside of the footprint of the intermediary substrate terminal array but within the footprint of the connector assembly 200.

Method of Manufacture

Figure 7:
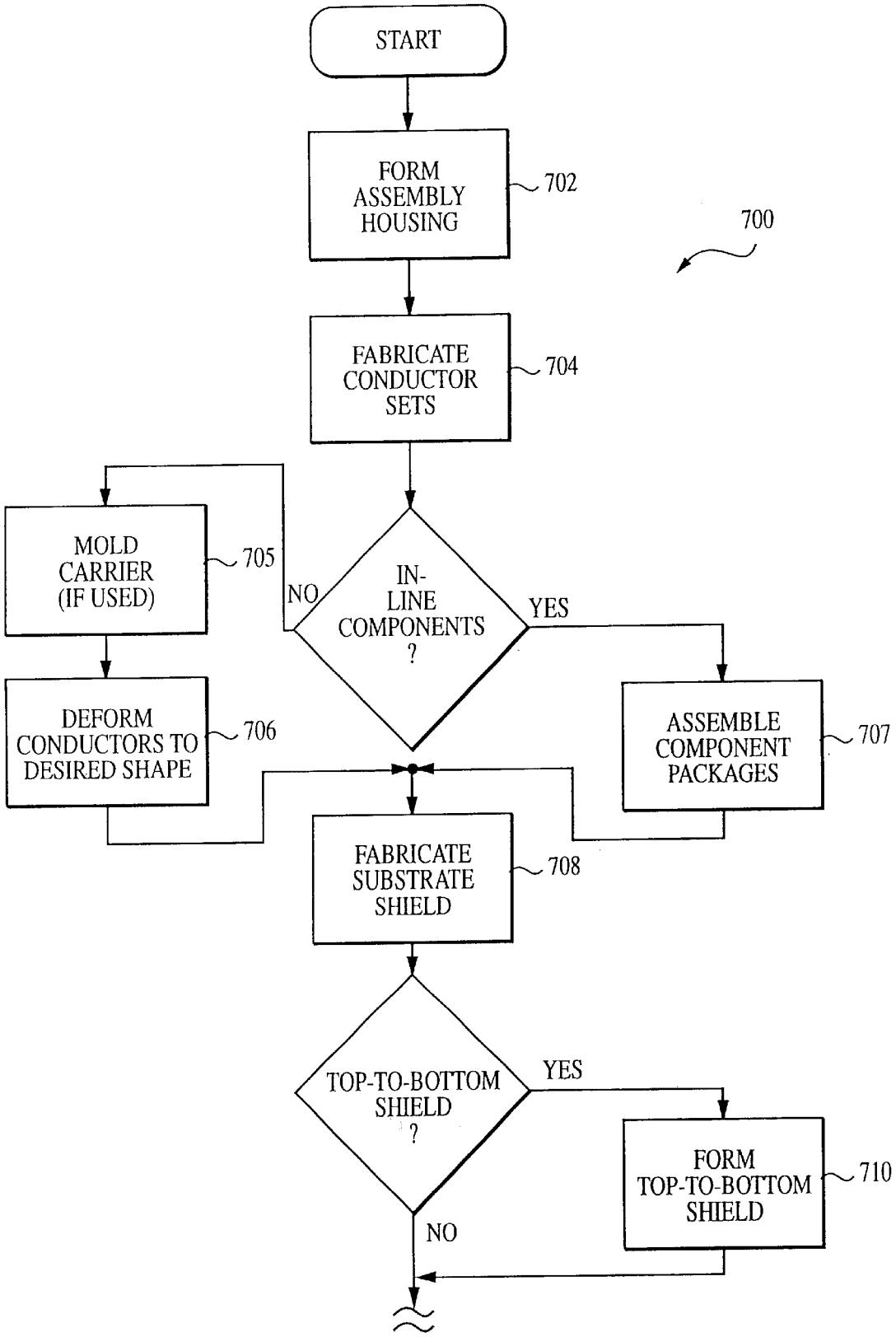
FIG. 7 is a logical flow diagram illustrating one exemplary embodiment of the method of manufacturing the connector assembly of the present invention.
Figure 7:
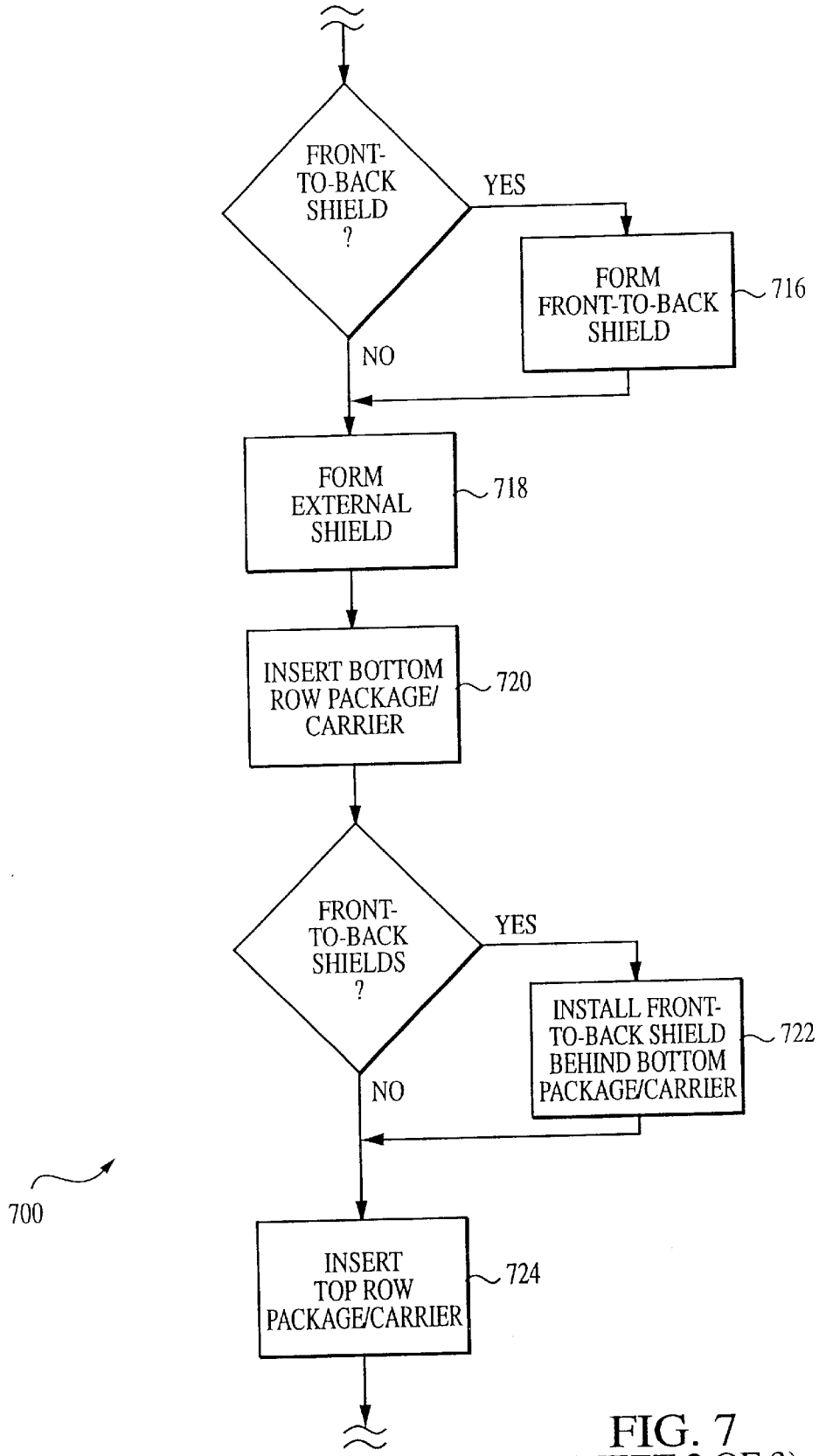
Figure 7:
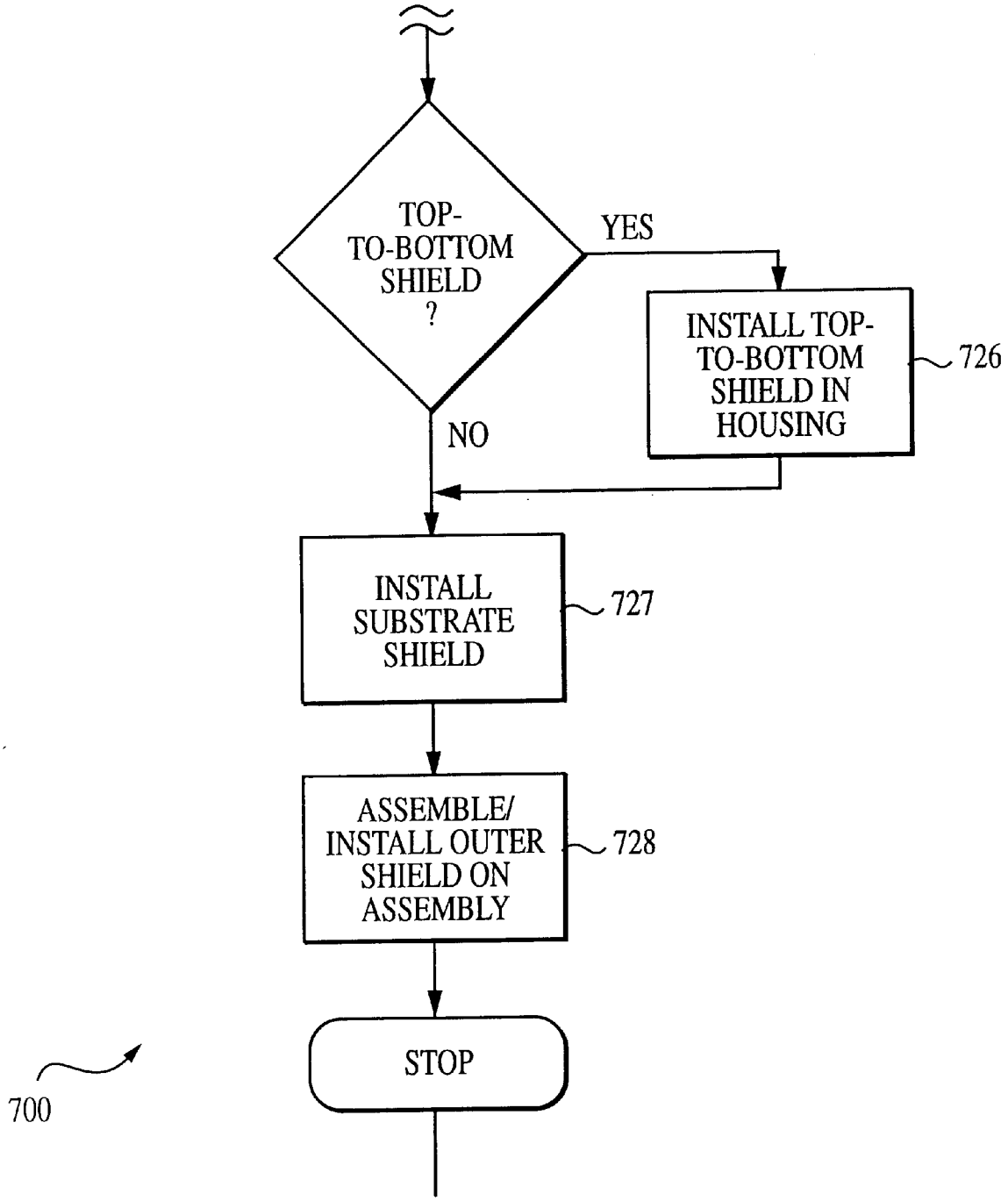
Figure 7A:
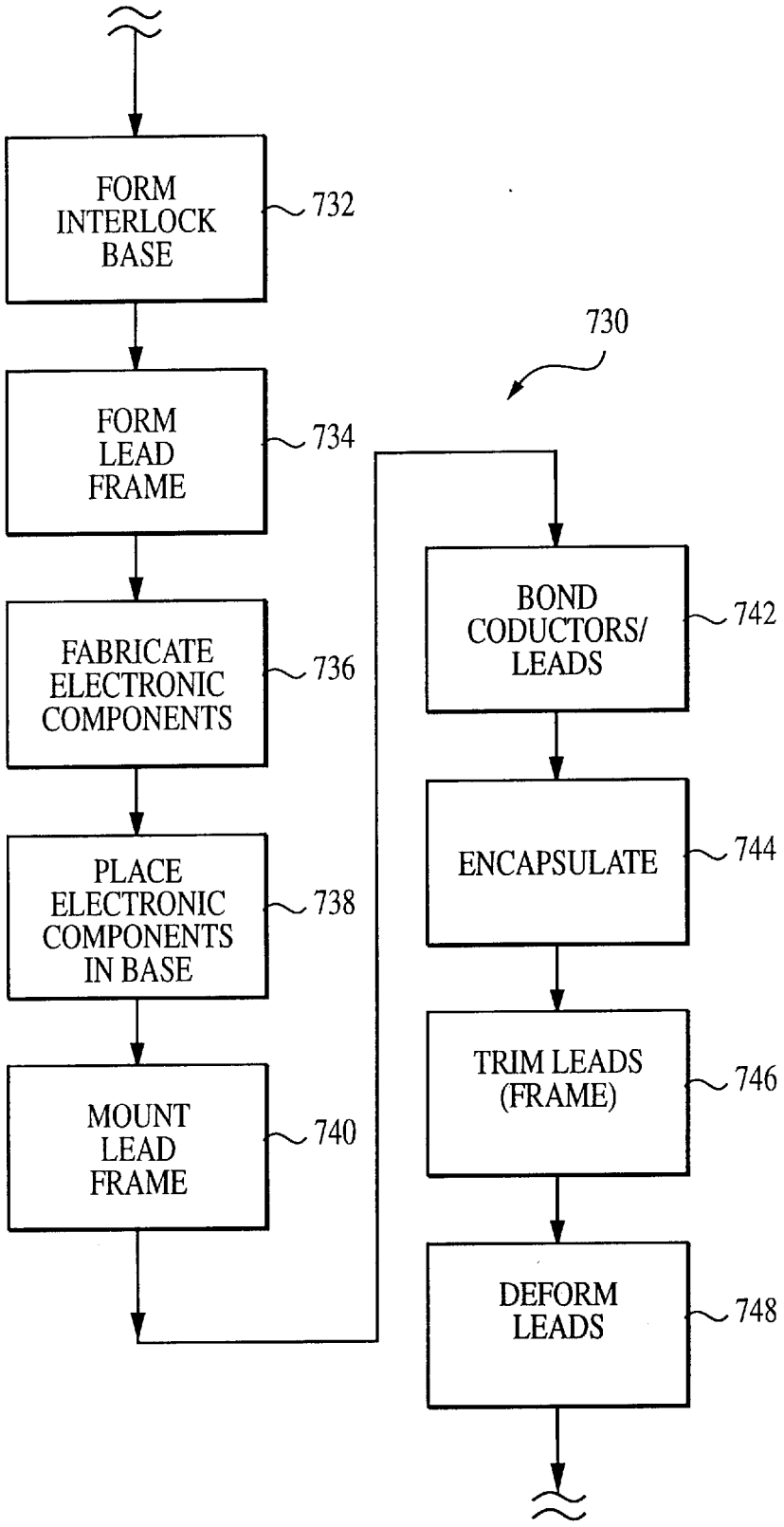
FIG. 7*a* is a logical flow diagram illustrating one exemplary embodiment of the method of manufacturing the component package of the connector assembly.

Referring now to FIGS. 7, 7*a*, and 2*a*, the method 700 of manufacturing the aforementioned connector assembly 200 is described in detail. It is noted that while the following description of the method 700 of FIG. 7 is cast in terms of the two-row connector assembly, the broader method of the invention is equally applicable to other configurations.

In the embodiment of FIG. 7, the method 700 generally comprises first forming the assembly housing element 202 of FIG. 2*a* in step 702. The housing is formed using an injection molding process of the type well known in the art, although other processes may be used. The injection molding process is chosen for its ability to accurately replicate small details of the mold, low cost, and ease of processing. Next, several conductor sets are provided in step 704. As previously described, the conductor sets comprise metallic (e.g., copper or aluminum alloy) strips having a substantially square or rectangular cross-section and sized to fit within the slots of the connectors in the housing 202.

In step 706, the conductors are partitioned into sets; a first set for use with the first row of connectors within the housing 202, and a second set for use with the second row, molded within their respective carriers 293, and formed to the desired shapes for these applications respectively. The conductors are formed to the desired shape(s) using a forming die or machine of the type well known in the art.

Alternatively, in step 707, the component packages 230, 232 are assembled. As shown in the embodiment of FIG. 7*a*, the process 730 of assembling the component packages comprises first forming an interlock base element 506 (step 732). A lead frame assembly (not shown) having a plurality of first and second conductors is next formed in step 734, the lead frame being adapted to cooperate with the lead channels 512 of the interlock base element 506. One or more electronic components, such as the aforementioned toroidal coils, are next formed and prepared in step 736, and loaded into the base element 506 (step 738), with the free ends of the component conductors disposed in the lead channels 512. The lead frame is then mounted on the base element 506 in step 740, and the component conductors bonded to the lead frame such as via a soldering process in step 742. The interlock base assembly is then encapsulated in an epoxy or other encapsulant material (step 744). The lead frame is then trimmed in step 746, and the conductors on each side of the package deformed to the desired shape (step 748). Note that the lead frame conductors on the two sides of the package 230, 232 comprise the upper and lower conductors 220*a*, 220*b*, respectively.

Figure 7B:
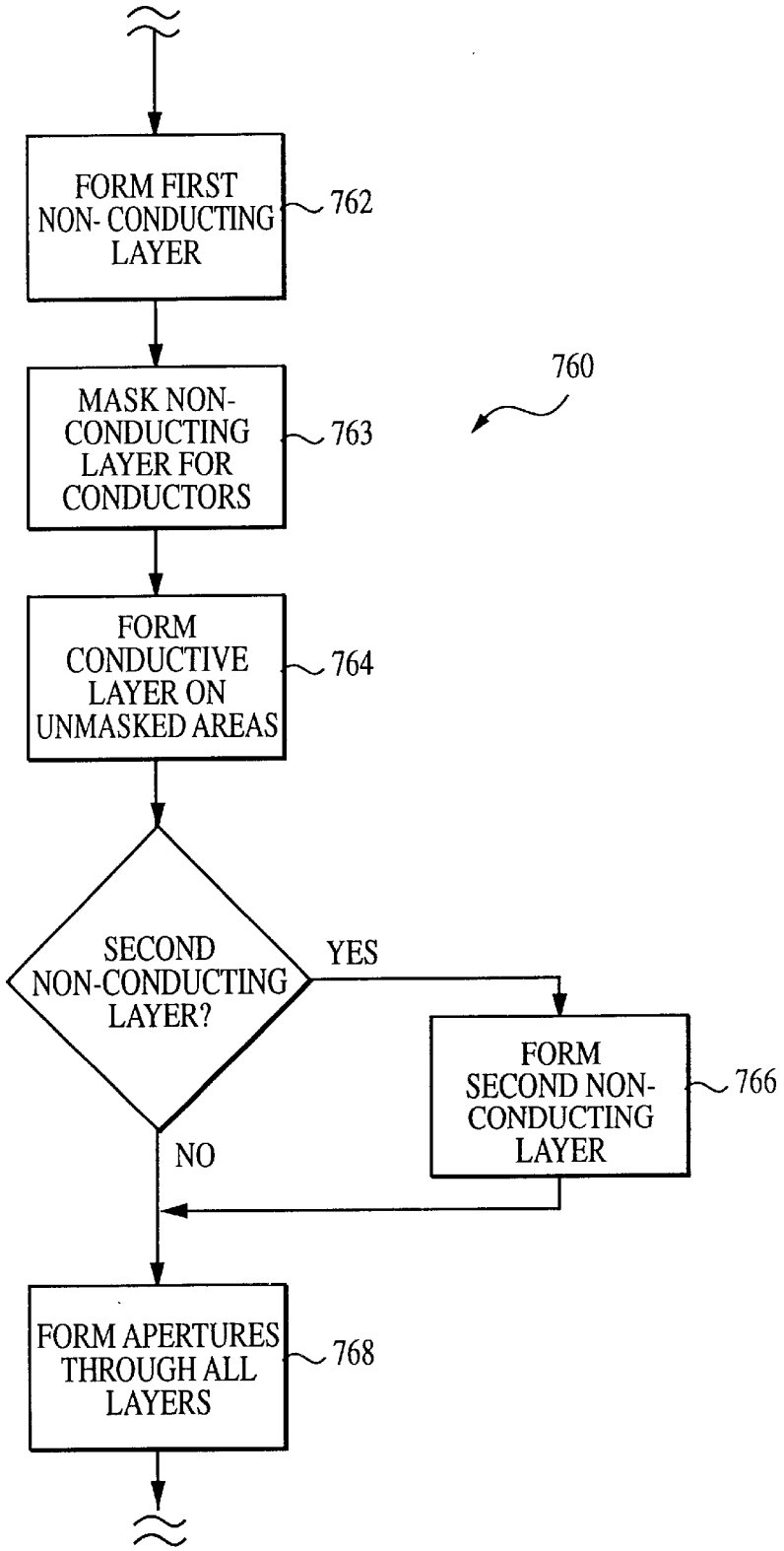
FIG. 7*b* is a logical flow diagram illustrating one exemplary embodiment of the method of manufacturing the substrate shield of the connector assembly.

Next, in step 708, the substrate shield 260 is fabricated. In one embodiment (FIG. 7*b*), the fabrication process 760 comprises forming a first layer from a non-conducting material (e.g., fiberglass) in the desired shape in step 762, and the subsequently forming a thin metallic layer of copper or alloy on one side of the fiberglass layer (step 764). Note that per step 763, the substrate is masked in several predetermined areas to prevent coating of the substrate in those areas with the metallic layer; this prevents the possibility of shorting between the metallic shield layer and the connector conductors when the latter are ultimately routed through the thickness of the substrate 260.

Another layer of non-conducting material is then optionally formed on the exposed side of the metal layer in step 766 if desired. Hence the substrate 260 resulting from the process 760 comprises a metal layer formed on one side of a fiberglass layer, or alternatively a metal layer "sandwiched" between two non-conductive layers when two fiberglass layers are utilized.

Next, the multi-layer substrate is perforated through its thickness with a number of apertures of predetermined size within the previously masked areas in step 768. The apertures are arranged in an array and with spacing (i.e., pitch) such that their position corresponds to the desired termination pattern. Any number of different methods of perforating the substrate may be used, including a rotating drill bit, punch, heated probe, or even laser energy. Alternatively, the apertures may be created within the non-conductive layer(s) during the formation of the latter (steps 762 and 766).

In step 710, the top-to-bottom shield element 305 is optionally formed. In the present embodiment, the shield element 305 is fabricated by stamping the shield from a sheet of copper-based metallic alloy of the type previously described, the stamped shield then being deformed at one edge and at the ends in order to form the shield retainer392 and end joints 394.

Next, in step 716, the front-to-back shield elements 307 are optionally fabricated. The fabrication process for these shield elements comprises providing a sheet of copper alloy in the desired thickness, and then stamping or perforating the sheet in the desired shape (e.g., the aforementioned "T" shape).

The external shield 272 is next formed in step 718. As previously described, the external shield comprises a phosphor bronze or "cartridge brass" 26000 material, the manufacture of which is well known in the metallurgic arts. The shield 272 is fabricated in a number of interlocking, substantially planar sections which, when assembled, cover most of the external surface area of the connector housing.

The bottom component packages 232 are then inserted into the housing element 202 in step 720, such that the packages are received into the cavity 234, and the upper conductors 220*a* of the packages received into respective ones of the grooves 222 of each connector formed in the assembly housing 202.

If the front-to-back shield elements 307 were fabricated per step 716, these shield elements 307 are next installed in step 722 within the housing element 202 and on the rear face of the installed component package, with the elongate portion 321 of the "T" received in the slots 323 present in the housing element 202 as previously described. The shield elements 307 are deformed such that the elongate portion 321 forms roughly a 90-degree bend so to allow the elements 307 to lay flat against the rear face of the installed (bottom) component package 232.

The top component packages 230 are next inserted into the housing element 202 in step 724, such that the packages are received into cavity 234 directly behind the bottom row packages 232, and the upper conductors 220*a* of the packages received into respective ones of the grooves 222 of each connector formed in the assembly housing 202. The front face of the top row package 230 contacts the exposed face of the installed front-to-back shield 307 in each recess, the shield being held firmly in place between the two packages 230,232 when fully assembled.

The top-to-bottom shield element 305 is next installed in the housing element 202 in step 726, the planar portion 319 of the shield 305 being received within the slot 311 formed in the front of the housing 202.

Next, in step 727, the substrate shield 260 that was fabricated in step 708 is installed on the connector assembly 200, such that the lower conductors 220*b* of both packages 230, 232 are received in and extend through the associated arrays of apertures formed in the substrate shield 260.

Lastly, in step 728, the external shield 272 is assembled on the outer portion of the connector assembly, and soldered (including soldering of the front-to-back shield elements 307 to the top-to-bottom shield element 305, and the soldering of the top-to-bottom shield element joints 394 to the corresponding locations on the external shield 272, per step 729. The substrate shield may also be secured to the external shield via soldering, adhesive, or other technique at one or more locations along the periphery of the lower edge of the external shield 272 where there is sufficient overlap between the components to form such a bond.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A connector assembly comprising:

a connector housing comprising a plurality of connectors, each of said connectors having:

a recess adapted to receive at least a portion of a modular plug, said modular plug having a plurality of first conductors disposed thereon;

a plurality of second conductors disposed at least partly within said recess, said second conductors being configured to form an electrical contact with respective ones of said first conductors when said modular plug is received within said recess, and form an electrical pathway between said first conductors and an external device; and a substrate shield disposed proximate to said plurality of connectors, said shield having a plurality of apertures corresponding to respective ones of said second conductors, said second conductors being received in respective ones of said apertures, said shield further being configured to mitigate the transmission of electronic noise through said shield during operation of at least one of said connectors;

wherein said substrate shield comprises:

a first layer, said first layer being substantially comprised of a non-conductive material; and a second layer disposed upon said first layer, said second layer comprising a metallic material;

wherein the area of said substrate shield immediately surrounding said apertures does not have said second layer.

2. The connector assembly of claim 1, further comprising a plurality of electronic components, respective ones of said electronic components being disposed in respective ones of said electrical pathways in order to condition electrical signals transmitted along said pathways.

3. The connector assembly of claim 2, wherein said electronic components comprise at least one toroid core device.

4. The connector assembly of claim 3, wherein said at least one toroid core device is disposed within an interlock base assembly.

5. The connector assembly of claim 4, wherein said interlock base assembly is substantially contained within a polymer encapsulant.

6. The connector assembly of claim 1, further comprising at least one contour element disposed within said recess, at least one of said second conductors being shaped to cooperate with said at least one contour element, thereby retaining said second conductors in position relative to said connector housing.

7. The connector assembly of claim 1, wherein said substrate further comprises a third layer, said third layer comprising electrically non-conductive material and being disposed upon said first layer on the side opposite of said second layer.

8. The connector assembly of claim 1, wherein said connectors are disposed as part of said connector housing in an array, said array comprising a row-and-column configuration of said connectors.

9. The connector assembly of claim 8, wherein said row-and-column configuration comprises at least:

a first row comprising a plurality of connectors disposed in a side-by-side configuration; and a second row comprising a plurality of connectors disposed in a side-by-side configuration;

wherein said first row is disposed substantially atop said second row, and at least a portion of said second conductors of the connectors of both first and second rows penetrate said substrate shield in a predetermined array.

10. The connector assembly of claim 9, further comprising a plurality of electronic components, respective ones of said electronic components being disposed in respective ones of said electrical pathways in order to condition electrical signals transmitted along said pathways.

11. The connector assembly of claim 9, further comprising a plurality of light sources associated with respective ones of said individual connectors, said light sources having conductors which penetrate said substrate shield.

12. The connector assembly of claim 11, wherein said conductors of said light sources associated with each of said connectors penetrate said substrate shield as part of said predetermined array.

13. The connector assembly of claim 8, further comprising at least one noise shield disposed between at least a portion of two of said rows of said row-and-column configuration of individual connectors.

14. The connector assembly of claim 13, further comprising a plurality of electronic components, respective ones of said electronic components being disposed in respective ones of said electrical pathways in order to condition electrical signals transmitted along said pathways.

15. The connector assembly of claim 14, further comprising a plurality of noise shield elements disposed between said electronic components associated with a first row of connectors and said electronic components associated with a second row of connectors.

16. The connector assembly of claim 15, wherein at least one of said noise shield elements is in electrical contact with said at least one noise shield.

17. The connector assembly of claim 15, further comprising at least one lateral noise shield element disposed between adjacent ones of said connectors within a given row of connectors in said array.

18. The connector assembly of claim 10, further comprising a plurality of noise shield elements disposed between said electronic components associated with a first row of connectors and said electronic components associated with a second row of connectors, said electronic components associated with said first and second rows being formed within common electronic component packages, each of said packages containing said electronic components of two adjacent connectors.

19. The connector assembly of 18, wherein said noise shield elements are each configured to be disposed between said component packages associated with two connector pairs, said pairs being disposed directly above or below each other in said row-and-column configuration.

20. The connector assembly of claim 19, wherein said noise shield elements each include an elongated portion extending therefrom, said elongated portion being adapted for coupling to another shield of said connector assembly.

21. An electronics assembly, comprising:

a first substrate having a plurality of electrically conductive terminals thereon;

a plurality of connectors disposed in an array on said substrate, said connectors each having:

a recess adapted to receive a modular plug having a plurality of first conductors disposed thereon;

a plurality of second conductors adapted to conduct and electrical signal between said first conductors of said modular plug and said electrically conductive terminals of said substrate; and at least one electrical component disposed within the electrical pathway between said first conductors and said conductive terminals; and a second substrate disposed between said first substrate and said array of connectors; said second substrate being adapted to shield at least said second conductors and said at least one electronic components from external noise; wherein said second substrate comprises:

a first layer, said first layer being substantially comprised of an electrically non-conductive material;

a second layer disposed upon said first layer, said second layer comprising a metallic material adapted to mitigate transmission of electronic noise; and a plurality of apertures corresponding to respective ones of said second conductors;

wherein the area of said substrate immediately surrounding said apertures does not have said second layer.

22. The electronics assembly of claim 21, further comprising a shield element disposed between at least two of said plurality of connectors.

23. The electronics assembly of claim 22, further comprising at least one shield element disposed between said electrical component of a first connector and said electrical component of a second connector of said array.

24. The electronics assembly of claim 23, further comprising a plurality of light sources disposed within said array, each of said connectors having at least one of said plurality of light sources associated therewith, each of said light sources being configured to emit light based on the presence of a predetermined condition existing within its associated connector.

25. A connector assembly comprising:

a plurality of individual connectors, each of said individual connectors having:

means for receiving at least a portion of a modular plug, said modular plug having a plurality of first conducting means disposed thereon;

second conducting means disposed at least partly within said means for receiving, said second conducting means being configured to form an electrical contact with respective ones of said first conducting means when said modular plug is received within said means for receiving, and form an electrical pathway between said first conducting means and an external device; and means for shielding being disposed proximate to said plurality of connectors, said shield having positioning means corresponding to respective ones of said second conducting means, said second conducting means being received in respective ones of said positioning means, said means for shielding further being configured to mitigate the transmission of electronic noise through said means for shielding during operation of at least one of said connectors;

wherein said means for shielding comprises:

a first layer, said first layer being substantially comprised of a metallic material; and a second layer disposed adjacent said first layer, said second layer comprising and electrically non-conductive material;

wherein the area of said means for shielding immediately surrounding said positioning means does not have said first layer.

26. The connector assembly of claim 25, further comprising:

means for conditioning an electrical signal, individual ones of said means for conditioning being disposed in said electrical pathway of at least two of said connectors in order to condition electrical signals carried thereon;

second means for shielding disposed between at least two of said connectors of said assembly;

third means for shielding disposed between said means for conditioning of said at least two connectors; and fourth means for shielding disposed around at least a portion of the exterior of said connector assembly.

27. A method of manufacturing an electronic device comprising a plurality of electrical connectors formed in an array, comprising:

forming a connector housing having an external surface and a plurality of individual connectors arranged in a first row and a second row, each of said connectors having a recess adapted to receive at least a portion of a modular plug;

providing a first set of conductors having a first predetermined shape, said first shape including a first end and a second end;

providing a second set of conductors having a second predetermined shape, said second shape including a first end and a second end;

disposing said first end of said first set of conductors at least partially within said recess of each of said connectors in said first row;

disposing said first end of said second set of conductors at least partially within said recess of each of said connectors in said second row;

providing a non-conductive substrate;

forming a plurality of apertures in said substrate;

forming a layer of metallic material over at least a portion of said non-conducting substrate excluding at least some areas immediately surrounding said apertures; and positioning said substrate in proximity to said housing such that said second ends of said first and second sets of conductors are received within respective ones of said apertures.

28. The method of claim 27, further comprising:

providing a first shield element;

disposing at least a portion of said first shield element between at least a portion of said connectors in said first and second rows;

providing a second shield element adapted to cover at least a portion of the external surface of said connector housing; and disposing said second shield element over said connector housing.

29. A method of shielding an array of electrical connectors from electronic noise, said array having at least first and second rows of connectors and being mounted on an electronic device, at least a portion of said connectors having conductors and electronic signal conditioning elements associated therewith, comprising:

providing a first noise shield having at least one non-conducting layer, a plurality of apertures formed in said at least one non-conducting layer, and an electrically conducting material disposed over said layer excluding at least some areas immediately surrounding said apertures;

disposing said first noise shield between at least a portion of said connectors and said electronic device, the distal ends of said conductors passing through said apertures;

providing a second noise shield;

disposing said second noise shield around the external surfaces of said array; and terminating said array to said electronic device using said distal ends of said conductors;

wherein said first and second noise shields cooperate to mitigate the transmission of noise through substantially all of said external surfaces of said array.

30. The method of claim 29, further comprising:

providing at least one third noise shield;

disposing said at least one third noise shield between said at least first and second rows of connectors;

providing at least one fourth noise shield; and disposing said at least one fourth noise shield between individual ones of said electronic signal conditioning elements.

31. An electronic device comprising a plurality of electrical connectors formed in an array, produced using the method comprising:

forming a connector housing having a plurality of individual connectors arranged in a first row and a second row, each of said connectors having a recess adapted to receive at least a portion of a modular plug having conductors disposed thereon;

providing a first set of conductors for conducting electrical current, said first set of conductors having a first predetermined shape, said first shape including a first end and a second end;

providing a second set of conductors for conducting electrical current, said second set of conductors having a second predetermined shape, said second shape including a first end and a second end;

disposing said first end of said first set of conductors at least partially within said recess of each of said connectors in said first row so as to place said first end in position within said recess to contact the conductors of said modular plug when said plug is received within said recess;

disposing said first end of said second set of conductors at least partially within said recess of each of said connectors in said second row so as to place said first end in position within said recess to contact the conductors of said modular plug when said plug is received within said recess;

providing a substrate adapted for mitigating the transmission of electronic noise there across, said substrate comprising at least one non-conducting layer;

forming a plurality of apertures in said substrate for receiving respective ones of said first and second sets of conductors;

disposing a conductive material over at least a portion of said non-conducting layer excluding at least some areas immediately surrounding said apertures; and positioning said substrate in proximity to said housing such that said second ends of said first and second sets of conductors are received within respective ones of said apertures.

32. A connector assembly comprising:

a connector housing comprising a plurality of connectors, each of said connectors having:

a recess adapted to receive at least a portion of a modular plug, said modular plug having a plurality of first conductors disposed thereon;

a plurality of second conductors disposed at least partly within said recess, said second conductors being configured to form an electrical contact with respective ones of said first conductors when said modular plug is received within said recess, and form an electrical pathway between said first conductors and an external device; and a substrate shield disposed proximate to said plurality of connectors and below said housing, said shield having a plurality of apertures corresponding to respective ones of said second conductors, said second conductors being received in respective ones of said apertures, said shield further being configured to mitigate the transmission of electronic noise through said shield during operation of at least one of said connectors;

wherein said substrate shield comprises:

a first layer, said first layer being substantially comprised of a non-conductive material; and a second layer disposed upon said first layer, said second layer comprising a metallic material;

wherein the area of said substrate shield immediately surrounding said apertures does not have said second layer.

33. A connector assembly comprising:

a connector housing comprising a plurality of connectors, each of said connectors having:

a recess adapted to receive at least a portion of a modular plug, said modular plug having a plurality of first conductors disposed thereon;

a plurality of second conductors disposed at least partly within said recess, said second conductors being configures to form an electrical contact with respective ones of said first conductors when said modular plug is received within said recess, and form an electrical pathway between said first conductors and an external device;

an external noise shield; and a substrate shield independent of said external noise shield and disposed proximate to said plurality of connectors, said shield having a plurality of apertures corresponding to respective ones of said second conductors, said second conductors being received in respective ones of said apertures, said shield further being configured to mitigate the transmission of electronic noise through said shield during operation of at least one of said connectors;

wherein said substrate shield comprises:

a first layer, said first layer being substantially comprised of a non-conductive material; and a second layer disposed upon said first layer, said second layer comprising a metallic material;

wherein the area of said substrate shield immediately surrounding said apertures does not have said second layer.

* * * * *